US010961710B2

(12) United States Patent
Collins et al.

(10) Patent No.: US 10,961,710 B2
(45) Date of Patent: Mar. 30, 2021

(54) PRE-ASSEMBLED WALL PANEL FOR UTILITY INSTALLATION

(71) Applicant: Innovative Building Technologies, LLC, Seattle, WA (US)

(72) Inventors: Arlan Collins, Seattle, WA (US); Mark Woerman, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 0 days.

(21) Appl. No.: 16/082,868

(22) PCT Filed: Mar. 7, 2017

(86) PCT No.: PCT/US2017/021179
§ 371 (c)(1),
(2) Date: Sep. 6, 2018

(87) PCT Pub. No.: WO2017/156016
PCT Pub. Date: Sep. 14, 2017

(65) Prior Publication Data

US 2019/0093356 A1 Mar. 28, 2019

Related U.S. Application Data

(60) Provisional application No. 62/304,862, filed on Mar. 7, 2016.

(51) Int. Cl.
*E04C 2/52* (2006.01)
*E04B 2/26* (2006.01)
(Continued)

(52) U.S. Cl.
CPC ..... *E04C 2/52* (2013.01); *E04B 2/26* (2013.01); *E04B 2/88* (2013.01); *E04C 2/322* (2013.01);
(Continued)

(58) Field of Classification Search
CPC ..... E04C 2/3405; E04C 2002/3455; E04C 2002/3444; E04C 2002/3461; E04C 2/521;
(Continued)

(56) References Cited

U.S. PATENT DOCUMENTS 1,168,556 A 1/1916 Robinson et al.
1,501,288 A 7/1924 Morley
(Continued)

FOREIGN PATENT DOCUMENTS

AU 2005200682 5/2005
AU 2012211472 2/2014
(Continued)

OTHER PUBLICATIONS

US 8,701,371 B2, 04/2014, Collins et al. (withdrawn)
(Continued)

*Primary Examiner* — Jessie T Fonseca

(57) ABSTRACT

An example pre-assembled wall panel may include a panel frame which includes a plurality of studs connected to opposing end members, first and second wall boards connected to opposite first and second sides of the panel frame, a plurality of spacers attached to at least one of the first and second wall boards and configured to support a finish panel in a spaced relation from the at least one of the first and second wall boards; and a pipe disposed between the first and second wall boards and extending between the opposing end members, wherein the pipe includes a pipe diverter, and wherein a free end of the pipe diverter passes through an opening in the first wall board or the second wall board.

25 Claims, 11 Drawing Sheets

(51) Int. Cl.
*E04C 2/34* (2006.01)
*E04C 2/32* (2006.01)
*E04B 2/88* (2006.01)

(52) U.S. Cl.
CPC ..... *E04C 2/3405* (2013.01); *E04C 2/521* (2013.01); *E04C 2002/3461* (2013.01)

(58) Field of Classification Search
CPC . E04C 2/324; E04C 2/322; E04C 2/46; E04C 2/52; E04B 2/88; E04B 2/26; E04F 17/08
See application file for complete search history.

(56) References Cited

U.S. PATENT DOCUMENTS 1,876,528 A 7/1931 Walters
1,883,376 A 10/1932 George et al.
2,160,161 A 5/1939 Marsh
2,419,319 A 4/1947 Lankton
2,495,862 A 1/1950 Osborn
2,562,050 A 7/1951 Lankton
2,686,420 A 8/1954 Youtz
2,722,724 A 11/1955 Miller
2,758,467 A 8/1956 Brown et al.
2,871,544 A 2/1959 Youtz
2,871,997 A 2/1959 Simpson et al.
2,877,990 A 3/1959 Goemann
2,946,413 A 7/1960 Weismann
3,017,723 A 1/1962 Von Heidenstam
3,052,449 A 9/1962 Long et al.
3,053,015 A 9/1962 George
3,053,509 A 9/1962 Haupt et al.
3,065,575 A 11/1962 Ray
3,079,652 A 3/1963 Wahlfeld
3,090,164 A 5/1963 Nels
3,184,893 A 5/1965 Booth
3,221,454 A 12/1965 Giulio
3,235,917 A 2/1966 Skubic
3,236,014 A 2/1966 Edgar
3,245,183 A 4/1966 Tessin
3,281,172 A 10/1966 Kuehl
3,315,424 A 4/1967 Smith
3,324,615 A 6/1967 Zinn
3,324,617 A * 6/1967 Knight ..... E04F 13/12 52/481.1
3,355,853 A 12/1967 Wallace
3,376,919 A 4/1968 Agostino
3,388,512 A 6/1968 Newman
3,392,497 A 7/1968 Vantine
3,411,252 A 11/1968 Boyle, Jr.
3,460,302 A 8/1969 Cooper
3,469,873 A 9/1969 Glaros
3,490,191 A 1/1970 Ekblom
3,533,205 A 10/1970 Pestel et al.
3,568,380 A 3/1971 Stucky et al.
3,579,935 A 5/1971 Regan et al.
3,590,393 A 7/1971 Hollander
3,594,965 A 7/1971 Saether
3,601,937 A * 8/1971 Campbell ..... E03C 1/01 52/27
3,604,174 A 9/1971 Nelson, Jr.
3,608,258 A 9/1971 Spratt
3,614,803 A 10/1971 Matthews
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,750,366 A 8/1973 Rich, Jr. et al.
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,885,367 A 5/1975 Thunberg
3,906,686 A 9/1975 Dillon
3,921,362 A 11/1975 Ortega
3,926,486 A 12/1975 Sasnett
3,971,605 A 7/1976 Sasnett
3,974,618 A 8/1976 Cortina
3,990,202 A 11/1976 Becker
4,018,020 A 4/1977 Sauer et al.
4,038,796 A 8/1977 Eckel
4,050,215 A 9/1977 Fisher
4,059,936 A 11/1977 Lukens
4,065,905 A 1/1978 Lely et al.
4,078,345 A 3/1978 Piazzalunga
4,107,886 A 8/1978 Ray
4,112,173 A 9/1978 Roudebush
4,114,335 A 9/1978 Carroll
4,142,255 A 3/1979 Togni
4,161,087 A * 7/1979 Levesque ..... E04C 2/384 52/210
4,170,858 A 10/1979 Walker
4,171,545 A 10/1979 Kann
4,176,504 A 12/1979 Huggins
4,178,343 A 12/1979 Rojo, Jr.
4,205,719 A 6/1980 Norell et al.
4,206,162 A 6/1980 Vanderklaauw
4,214,413 A 7/1980 Gonzalez Espinosa de Los
4,221,441 A 9/1980 Bain
4,226,061 A 10/1980 Day, Jr.
4,227,360 A 10/1980 Balinski
4,248,020 A 2/1981 Zielinski et al.
4,251,974 A 2/1981 Vanderklaauw
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu
4,441,286 A 4/1984 Skvaril
4,447,987 A 5/1984 Lesosky
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,531,336 A 7/1985 Gartner
4,592,175 A 6/1986 Werner
4,646,495 A 3/1987 Chalik
4,648,228 A 3/1987 Kiselewski
4,655,011 A 4/1987 Borges
4,688,750 A 8/1987 Teague et al.
4,712,352 A 12/1987 Low
4,757,663 A 7/1988 Kuhr
4,813,193 A 3/1989 Altizer
4,856,244 A 8/1989 Clapp
4,862,663 A 9/1989 Krieger
4,893,435 A 1/1990 Shalit
4,910,932 A 3/1990 Honigman
4,918,897 A 4/1990 Luedtke
4,919,164 A * 4/1990 Barenburg ..... E03C 1/01 137/15.08
4,974,366 A 12/1990 Tizzoni
4,991,368 A 2/1991 Amstutz
5,009,043 A 4/1991 Kurrasch
5,010,690 A 4/1991 Geoffrey
5,036,638 A 8/1991 Kurtz, Jr.
5,076,310 A * 12/1991 Barenburg ..... E03C 1/01 137/15.08
5,079,890 A 1/1992 Kubik et al.
5,127,203 A 7/1992 Paquette
5,127,760 A 7/1992 Brady
5,154,029 A 10/1992 Sturgeon
5,185,971 A 2/1993 Johnson, Jr.

(56) References Cited

U.S. PATENT DOCUMENTS 5,205,091 A 4/1993 Brown
5,212,921 A 5/1993 Unruh
5,228,254 A 7/1993 Honeycutt, Jr.
5,233,810 A 8/1993 Jennings
5,254,203 A 10/1993 Corston
5,307,600 A 5/1994 Simon, Jr.
5,359,816 A 11/1994 Iacouides
5,359,820 A 11/1994 McKay
5,361,556 A 11/1994 Menchetti
5,402,612 A 4/1995 diGirolamo et al.
5,412,913 A 5/1995 Daniels et al.
5,426,894 A 6/1995 Headrick
5,452,552 A 9/1995 Ting
5,459,966 A 10/1995 Suarez
5,471,804 A 12/1995 Winter, IV
5,483,773 A 1/1996 Parisien
5,493,838 A 2/1996 Ross
5,509,242 A 4/1996 Rechsteiner et al.
5,519,971 A 5/1996 Ramirez
5,528,877 A 6/1996 Franklin
5,531,539 A 7/1996 Crawford
5,584,142 A 12/1996 Spiess
5,592,796 A 1/1997 Landers
5,593,115 A * 1/1997 Lewis ..... F16L 3/227 248/68.1
5,611,173 A 3/1997 Headrick et al.
5,628,158 A 5/1997 Porter
5,640,824 A 6/1997 Johnson
5,660,017 A 8/1997 Houghton
5,678,384 A 10/1997 Maze
5,697,189 A 12/1997 Miller
5,699,643 A 12/1997 Kinard
5,706,607 A 1/1998 Frey
5,724,773 A 3/1998 Hall
5,735,100 A 4/1998 Campbell
5,743,330 A 4/1998 Bilotta et al.
5,746,034 A 5/1998 Luchetti et al.
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,970,680 A 10/1999 Powers
5,987,841 A 11/1999 Campo
5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Iri et al.
6,073,413 A 6/2000 Tongiatama
6,076,319 A 6/2000 Hendershot
6,086,350 A 7/2000 Del Monte
6,128,877 A 10/2000 Goodman et al.
6,151,851 A 11/2000 Carter
6,154,774 A 11/2000 Furlong
6,170,214 B1 1/2001 Treister et al.
6,199,336 B1 3/2001 Poliquin
6,240,704 B1 6/2001 Porter
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt
6,371,188 B1 4/2002 Baczuk
6,393,774 B1 5/2002 Fisher
6,421,968 B2 7/2002 Degelsegger
6,427,407 B1 8/2002 Wilson
6,430,883 B1 8/2002 Paz et al.
6,446,396 B1 9/2002 Marangoni et al.
6,481,172 B1 11/2002 Porter
6,484,460 B2 11/2002 VanHaitsma
6,571,523 B2 * 6/2003 Chambers ..... E04B 1/14 52/270
6,625,937 B1 9/2003 Parker
6,651,393 B2 11/2003 Don
6,688,056 B2 * 2/2004 Von Hoyningen Huene ..... E04B 2/745 52/238.1
6,729,094 B1 5/2004 Spencer et al.
6,748,709 B1 6/2004 Sherman et al.
6,807,790 B2 10/2004 Strickland et al.
6,837,013 B2 1/2005 Foderberg et al.
6,922,960 B2 8/2005 Sataka
6,935,079 B1 8/2005 Julian et al.
6,964,410 B1 11/2005 Hansen
7,007,343 B2 3/2006 Weiland
7,059,017 B1 6/2006 Rosko
7,143,555 B2 12/2006 Miller
RE39,462 E 1/2007 Brady
7,389,620 B1 6/2008 McManus
7,395,999 B2 7/2008 Walpole
7,444,793 B2 11/2008 Raftery et al.
7,467,469 B2 12/2008 Wall
7,484,329 B2 2/2009 Fiehler
7,484,339 B2 2/2009 Fiehler
7,493,729 B1 2/2009 Semmes
7,546,715 B2 6/2009 Roen
7,574,837 B2 8/2009 Hagen, Jr. et al.
7,640,702 B2 1/2010 Termohlen
7,658,045 B2 2/2010 Elliott et al.
7,676,998 B2 3/2010 Lessard
7,694,462 B2 4/2010 O'Callaghan
7,721,491 B2 5/2010 Appel
7,748,193 B2 7/2010 Knigge et al.
7,908,810 B2 3/2011 Payne, Jr. et al.
7,921,965 B1 4/2011 Surace
7,941,985 B2 5/2011 Simmons
7,966,778 B2 6/2011 Klein
8,051,623 B2 11/2011 Loyd
D652,956 S * 1/2012 Tanaka ..... D25/138
8,096,084 B2 1/2012 Studebaker et al.
8,109,058 B2 2/2012 Miller
8,127,507 B1 3/2012 Bilge
8,166,716 B2 5/2012 Macdonald et al.
8,234,827 B1 8/2012 Schroeder, Sr.
8,234,833 B2 8/2012 Miller
8,251,175 B1 8/2012 Englert et al.
8,276,328 B2 10/2012 Pépin
8,322,086 B2 12/2012 Weber
8,359,808 B2 1/2013 Stephens, Jr.
8,424,251 B2 4/2013 Tinianov
8,490,349 B2 7/2013 Lutzner
8,505,259 B1 8/2013 Degtyarev
8,539,732 B2 9/2013 Leahy
8,555,581 B2 10/2013 Amend
8,555,589 B2 10/2013 Semmens et al.
8,555,598 B2 10/2013 Wagner et al.
8,621,806 B2 1/2014 Studebaker et al.
8,621,818 B1 1/2014 Glenn et al.
8,631,616 B2 1/2014 Carrion et al.
8,733,046 B2 5/2014 Naidoo
8,769,891 B2 7/2014 Kelly
8,826,613 B1 9/2014 Chrien
8,833,025 B2 9/2014 Krause
8,950,132 B2 2/2015 Collins et al.
8,966,845 B1 3/2015 Ciuperca
8,978,324 B2 3/2015 Collins et al.
8,991,111 B1 3/2015 Harkins
8,997,424 B1 4/2015 Miller
9,027,307 B2 5/2015 Collins et al.
9,382,709 B2 7/2016 Collins et al.
9,637,911 B2 5/2017 Doupe et al.
9,683,361 B2 6/2017 Timberlake et al.
10,041,289 B2 8/2018 Collins et al.
10,260,250 B2 4/2019 Collins et al.
10,273,686 B2 4/2019 Lake
10,323,428 B2 6/2019 Collins et al.
10,370,851 B2 * 8/2019 Bodwell ..... E04C 2/322
10,501,929 B2 12/2019 Henry
10,731,330 B2 8/2020 Petricca

(56) References Cited

U.S. PATENT DOCUMENTS

2002/0059763 A1 5/2002 Wong
2002/0092703 A1 7/2002 Gelin et al.
2002/0134036 A1 9/2002 Daudet et al.
2002/0170243 A1 11/2002 Don
2002/0184836 A1 12/2002 Takeuchi et al.
2003/0005653 A1 1/2003 Sataka
2003/0056445 A1 3/2003 Cox
2003/0084629 A1 5/2003 Strickland et al.
2003/0101680 A1 6/2003 Lee
2003/0140571 A1 7/2003 Muha et al.
2003/0167712 A1 9/2003 Robertson
2003/0167719 A1 9/2003 Alderman
2003/0200706 A1 10/2003 Kahan et al.
2003/0221381 A1 12/2003 Ting
2004/0065036 A1 4/2004 Capozzo
2004/0103596 A1 6/2004 Don
2004/0221518 A1* 11/2004 Westra ..... E04B 1/94 52/79.1
2005/0081484 A1 4/2005 Yland
2005/0108957 A1 5/2005 Quesada
2005/0188626 A1 9/2005 Johnson
2005/0188632 A1 9/2005 Rosen
2005/0198919 A1 9/2005 Hester, Jr.
2005/0204697 A1 9/2005 Rue
2005/0204699 A1 9/2005 Rue
2005/0210764 A1 9/2005 Foucher et al.
2005/0210798 A1 9/2005 Burg et al.
2005/0235571 A1 10/2005 Ewing et al.
2005/0235581 A1 10/2005 Cohen
2005/0247013 A1 11/2005 Walpole
2005/0262771 A1 12/2005 Gorman
2006/0021289 A1 2/2006 Elmer
2006/0070321 A1 4/2006 Au
2006/0090326 A1 5/2006 Corbett
2006/0096202 A1 5/2006 Delzotto
2006/0117689 A1 6/2006 Onken et al.
2006/0137293 A1 6/2006 Klein
2006/0143856 A1 7/2006 Rosko et al.
2006/0150521 A1 7/2006 Henry
2006/0179764 A1 8/2006 Ito
2006/0248825 A1 11/2006 Garringer
2006/0277841 A1 12/2006 Majusiak
2007/0000198 A1 1/2007 Payne
2007/0074464 A1 4/2007 Eldridge
2007/0107349 A1 5/2007 Erker
2007/0151196 A1 7/2007 Boatwright
2007/0157539 A1 7/2007 Knigge et al.
2007/0163197 A1 7/2007 Payne et al.
2007/0209306 A1 9/2007 Andrews et al.
2007/0234657 A1 10/2007 Speyer et al.
2007/0251168 A1 11/2007 Turner
2007/0283640 A1 12/2007 Shivak et al.
2007/0294954 A1 12/2007 Barrett
2008/0000177 A1 1/2008 Siu
2008/0057290 A1 3/2008 Guevara et al.
2008/0092472 A1 4/2008 Doerr et al.
2008/0098676 A1 5/2008 Hutchens
2008/0099283 A1 5/2008 Reigwein
2008/0104901 A1 5/2008 Olvera
2008/0168741 A1 7/2008 Gilgan
2008/0178542 A1 7/2008 Williams
2008/0178642 A1 7/2008 Sanders
2008/0190053 A1 8/2008 Surowiecki
2008/0202048 A1 8/2008 Miller et al.
2008/0222981 A1 9/2008 Gobbi
2008/0229669 A1 9/2008 Abdollahzadeh et al.
2008/0245007 A1 9/2008 McDonald
2008/0279620 A1 11/2008 Berg
2008/0282626 A1 11/2008 Powers, Jr.
2008/0289265 A1 11/2008 Lessard
2008/0295443 A1 12/2008 Simmons
2008/0295450 A1 12/2008 Yogev
2009/0031652 A1 2/2009 Ortega Gatalan
2009/0038764 A1 2/2009 Pilz
2009/0064611 A1 3/2009 Hall et al.
2009/0077916 A1 3/2009 Scuderi et al.
2009/0090074 A1 4/2009 Klein
2009/0100760 A1 4/2009 Ewing
2009/0100769 A1 4/2009 Barrett
2009/0100796 A1 4/2009 Denn et al.
2009/0107065 A1 4/2009 LeBlang
2009/0113820 A1 5/2009 Deans
2009/0134287 A1 5/2009 Klosowski
2009/0165399 A1 7/2009 Campos Gines
2009/0188192 A1 7/2009 Studebaker et al.
2009/0188193 A1 7/2009 Studebaker et al.
2009/0205277 A1 8/2009 Gibson
2009/0249714 A1 10/2009 Combs et al.
2009/0277122 A1 11/2009 Howery et al.
2009/0282766 A1 11/2009 Roen
2009/0283359 A1 11/2009 Ravnaas
2009/0293395 A1 12/2009 Porter
2009/0313931 A1 12/2009 Porter
2010/0050556 A1 3/2010 Burns
2010/0058686 A1 3/2010 Henriquez
2010/0064590 A1 3/2010 Jones et al.
2010/0064601 A1 3/2010 Napier
2010/0146874 A1 6/2010 Brown
2010/0146893 A1 6/2010 Dickinson
2010/0186313 A1 7/2010 Stanford et al.
2010/0212255 A1 8/2010 Lesoine
2010/0218443 A1 9/2010 Studebaker
2010/0229472 A1* 9/2010 Malpas ..... E04C 2/521 52/79.1
2010/0235206 A1 9/2010 Miller et al.
2010/0263308 A1 10/2010 Olvera
2010/0275544 A1 11/2010 Studebaker et al.
2010/0313518 A1 12/2010 Berg
2010/0325971 A1 12/2010 Leahy
2010/0325989 A1 12/2010 Leahy
2011/0023381 A1 2/2011 Weber
2011/0041411 A1 2/2011 Aragon
2011/0056147 A1 3/2011 Beaudet
2011/0113709 A1 5/2011 Pilz et al.
2011/0113715 A1 5/2011 Tonyan et al.
2011/0126484 A1 6/2011 Carrion et al.
2011/0146180 A1 6/2011 Klein et al.
2011/0154766 A1 6/2011 Kralic et al.
2011/0162167 A1 7/2011 Blais
2011/0219720 A1 9/2011 Strickland et al.
2011/0247281 A1 10/2011 Pilz et al.
2011/0268916 A1 11/2011 Pardue, Jr.
2011/0296769 A1 12/2011 Collins et al.
2011/0296778 A1* 12/2011 Collins ..... E04B 2/72 52/220.1
2011/0296789 A1 12/2011 Collins et al.
2011/0300386 A1 12/2011 Pardue, Jr.
2012/0073227 A1 3/2012 Urusoglu
2012/0096800 A1 4/2012 Berg
2012/0137610 A1 6/2012 Knight et al.
2012/0151869 A1 6/2012 Miller
2012/0167505 A1 7/2012 Krause
2012/0186174 A1 7/2012 LeBlang
2012/0210658 A1 8/2012 Logan
2012/0291378 A1 11/2012 Schroeder et al.
2012/0297712 A1 11/2012 Lutzner et al.
2012/0317923 A1 12/2012 Herdt et al.
2013/0025222 A1 1/2013 Mueller
2013/0025966 A1 1/2013 Nam et al.
2013/0036688 A1 2/2013 Gosain
2013/0067832 A1 3/2013 Collins et al.
2013/0111840 A1 5/2013 Bordener
2013/0133277 A1 5/2013 Lewis
2013/0232887 A1 9/2013 Donnini
2014/0013678 A1 1/2014 Deverini
2014/0013684 A1 1/2014 Kelly et al.
2014/0013695 A1 1/2014 Wolynski et al.
2014/0047780 A1 2/2014 Quinn et al.
2014/0059960 A1 3/2014 Cole
2014/0069035 A1 3/2014 Collins et al.
2014/0069040 A1 3/2014 Gibson
2014/0069050 A1 3/2014 Bolin
2014/0083046 A1 3/2014 Yang

(56) References Cited

U.S. PATENT DOCUMENTS

| | | | | |
|---|---|---|---|---|
| 2014/0090323 | A1* | 4/2014 | Glancy | E04C 2/292 52/404.2 |
| 2014/0130441 | A1 | 5/2014 | Sugihara et al. | |
| 2014/0317841 | A1 | 10/2014 | Dejesus et al. | |
| 2014/0338280 | A1 | 11/2014 | Tanaka et al. | |
| 2015/0007415 | A1 | 1/2015 | Kalinowski | |
| 2015/0093184 | A1 | 4/2015 | Henry | |
| 2015/0096251 | A1 | 4/2015 | McCandless et al. | |
| 2015/0121797 | A1 | 5/2015 | Brown et al. | |
| 2015/0128518 | A1 | 5/2015 | Knight et al. | |
| 2015/0136361 | A1 | 5/2015 | Gregory | |
| 2015/0152634 | A1 | 6/2015 | Unger | |
| 2015/0211227 | A1 | 7/2015 | Collins et al. | |
| 2015/0233108 | A1 | 8/2015 | Eggleston, II et al. | |
| 2015/0252558 | A1 | 9/2015 | Chin | |
| 2015/0284950 | A1 | 10/2015 | Stramandinoli | |
| 2015/0297926 | A1 | 10/2015 | Dzegan | |
| 2015/0308096 | A1 | 10/2015 | Merhi et al. | |
| 2016/0002912 | A1 | 1/2016 | Doupe et al. | |
| 2016/0053475 | A1 | 2/2016 | Locker et al. | |
| 2016/0122996 | A1 | 5/2016 | Timberlake et al. | |
| 2016/0145933 | A1 | 5/2016 | Condon et al. | |
| 2016/0258160 | A1 | 9/2016 | Radhouane et al. | |
| 2016/0290030 | A1 | 10/2016 | Collins et al. | |
| 2016/0319534 | A1 | 11/2016 | Bernardo | |
| 2017/0037613 | A1 | 2/2017 | Collins et al. | |
| 2017/0284095 | A1 | 10/2017 | Collins et al. | |
| 2017/0299198 | A1 | 10/2017 | Collins et al. | |
| 2017/0306624 | A1 | 10/2017 | Graham et al. | |
| 2017/0306625 | A1 | 10/2017 | Collins et al. | |
| 2017/0342735 | A1 | 11/2017 | Collins et al. | |
| 2018/0038103 | A1 | 2/2018 | Neumayr | |
| 2018/0148926 | A1 | 5/2018 | Lake | |
| 2018/0209136 | A1 | 7/2018 | Aylward et al. | |
| 2018/0223521 | A1 | 8/2018 | Uno et al. | |
| 2018/0328056 | A1 | 11/2018 | Collins et al. | |
| 2019/0032327 | A1 | 3/2019 | Musson | |
| 2019/0119908 | A1 | 4/2019 | Petricca | |
| 2019/0136508 | A1 | 5/2019 | Chaillan | |
| 2019/0249409 | A1 | 8/2019 | Boyd et al. | |
| 2020/0224407 | A1 | 7/2020 | Ng | |

FOREIGN PATENT DOCUMENTS

| | | |
|---|---|---|
| CN | 1313921 | 9/2001 |
| CN | 1234087 | 11/2002 |
| CN | 1742144 | 3/2006 |
| CN | 20137279 | 3/2008 |
| CN | 101426986 | 5/2009 |
| CN | 101821462 | 9/2010 |
| CN | 101831963 | 9/2010 |
| CN | 102105642 | 6/2011 |
| CN | 201952944 | 8/2011 |
| CN | 202117202 | 1/2012 |
| CN | 102459775 | 5/2012 |
| CN | 102587693 | 7/2012 |
| CN | 202299241 | 7/2012 |
| CN | 202391078 | 8/2012 |
| CN | 102733511 | 10/2012 |
| CN | 205024886 | 2/2016 |
| CN | 206070835 | 4/2017 |
| CN | 108487464 | 9/2018 |
| DE | 4205812 | 9/1993 |
| DE | 9419429 | 2/1995 |
| DE | 20002775 | 8/2000 |
| DE | 19918153 | 11/2000 |
| DE | 20315506 | 11/2004 |
| DE | 202008007139 | 10/2009 |
| EP | 0612896 | 8/1994 |
| EP | 1045078 | 10/2000 |
| EP | 0235029 | 2/2002 |
| EP | 1375804 | 1/2004 |
| EP | 1568828 | 8/2005 |
| EP | 2128353 | 12/2009 |
| EP | 2213808 | 8/2010 |
| EP | 2238872 | 10/2010 |
| EP | 1739246 | 1/2011 |
| EP | 2281964 | 2/2011 |
| EP | 3133220 | 2/2017 |
| FR | 1317681 | 5/1963 |
| FR | 2988749 | 10/2013 |
| FR | 2765906 | 1/2019 |
| GB | 898905 | 6/1962 |
| GB | 2481126 | 12/2011 |
| JP | S46-006980 | 12/1971 |
| JP | S49-104111 | 9/1974 |
| JP | 52-015934 | 4/1977 |
| JP | 53-000014 | 1/1978 |
| JP | 53-156364 | 12/1978 |
| JP | 54-084112 | 6/1979 |
| JP | S54-145910 | 11/1979 |
| JP | 56-131749 | 10/1981 |
| JP | 57-158451 | 9/1982 |
| JP | S59-065126 | 5/1984 |
| JP | S60-019606 | 2/1985 |
| JP | 61-144151 | 9/1986 |
| JP | S61-201407 | 12/1986 |
| JP | S6358035 | 3/1988 |
| JP | H01-153013 | 10/1989 |
| JP | H0310985 | 1/1991 |
| JP | H049373 | 3/1992 |
| JP | 6-12178 | 2/1994 |
| JP | 06-212721 | 8/1994 |
| JP | H06-220932 | 8/1994 |
| JP | H07-173893 | 7/1995 |
| JP | H0752887 | 12/1995 |
| JP | 8-189078 | 7/1996 |
| JP | H08-189078 | 7/1996 |
| JP | H09-228510 | 9/1997 |
| JP | 2576409 | 4/1998 |
| JP | 10234493 | 9/1998 |
| JP | 11-117429 | 4/1999 |
| JP | H11-100926 | 4/1999 |
| JP | 2000-34801 | 2/2000 |
| JP | 2000144997 | 5/2000 |
| JP | 2000-160861 | 6/2000 |
| JP | 3137760 | 2/2001 |
| JP | 3257111 | 2/2002 |
| JP | 2002-309691 | 10/2002 |
| JP | 2002536615 | 10/2002 |
| JP | 2002364104 | 12/2002 |
| JP | 2003-505624 | 2/2003 |
| JP | 2003-278300 | 10/2003 |
| JP | 2003-293493 | 10/2003 |
| JP | 2003278300 | 10/2003 |
| JP | 2004108031 | 4/2004 |
| JP | 2004-344194 | 12/2004 |
| JP | 3664280 | 6/2005 |
| JP | 2006-161406 | 6/2006 |
| JP | 3940621 | 7/2007 |
| JP | 3137760 | 12/2007 |
| JP | 2008-063753 | 3/2008 |
| JP | 2008073434 | 4/2008 |
| JP | 2008110104 | 5/2008 |
| JP | 2009-257713 | 11/2009 |
| JP | 2010-185264 | 8/2010 |
| JP | 2010185264 | 8/2010 |
| JP | 2010245918 | 10/2010 |
| JP | 2011032802 | 2/2011 |
| JP | 3187449 | 11/2013 |
| JP | 2015-117502 | 6/2015 |
| KR | 1019990052255 | 7/1999 |
| KR | 1019990053902 | 7/1999 |
| KR | 100236196 | 12/1999 |
| KR | 102000200413000 | 10/2000 |
| KR | 20060066931 | 6/2006 |
| KR | 20080003326 | 8/2008 |
| KR | 20-2008-0003326 | 7/2012 |
| KR | 101481790 | 1/2015 |
| KR | 20180092677 | 8/2018 |
| WO | 1991007557 | 5/1991 |
| WO | 1997022770 | 6/1997 |
| WO | 200046457 | 8/2000 |

(56) References Cited

FOREIGN PATENT DOCUMENTS

| | | |
|---|---|---|
| WO | 0058583 | 10/2000 |
| WO | 2002035029 | 5/2002 |
| WO | 2006091864 | 8/2006 |
| WO | 2007059003 | 5/2007 |
| WO | 2007080561 | 7/2007 |
| WO | 2008113207 | 9/2008 |
| WO | 2010030060 | 3/2010 |
| WO | 2010037938 | 4/2010 |
| WO | 2011015681 | 2/2011 |
| WO | 2011116622 | 9/2011 |
| WO | 2015050502 | 4/2015 |
| WO | 2016/032537 | 3/2016 |
| WO | 2016/033429 | 3/2016 |
| WO | 2016032537 | 3/2016 |
| WO | 2016032538 | 3/2016 |
| WO | 2016032539 | 3/2016 |
| WO | 2016032540 | 3/2016 |
| WO | 2016033429 | 3/2016 |
| WO | 2016033525 | 3/2016 |

OTHER PUBLICATIONS

EPO, Extended European Search Report for European Patent Application No. 17763910.1, dated Jan. 28, 2020, 13 pages.
EPO, Extended European Search Report for European Patent Application No. 17763914.3, dated Nov. 19, 2019, 10 pages.
EPO, Extended European Search Report for European Patent Application No. 17763913.5, dated Oct. 16, 2019, 8 pages.
EPO, Partial European Search Report for European Patent Application No. 17763910.1, dated Oct. 17, 2019, 16 pages.
EPO, Extended European Search Report for European Patent Application No. 17763907.7, dated Sep. 13, 2019, 13 pages.
Written Opinion for Singapore Patent Application No. 11201807196R, dated Nov. 18, 2019, 12 pages.
WIPO, "International Search Report and Written Opinion for PCT Application No. PCT/US2019/038557", dated Sep. 4, 2019, 67 pages.
U.S. Appl. No. 12/796,603, filed Jun. 8, 2010, Collins et al.
European Search Report in PCT/US2015/047383 dated Jun. 22, 2018, 10 Pages.
WIPO, International Search Report and Written opinion for International Application No. PCT/US/2014/053614 dated Dec. 18, 2014, 11 pages.
WIPO, International Search Report and Written opinion for International Application No. PCT/US/2014/053615 dated Dec. 17, 2014, 11 pages.
WIPO, International Search Report and Written opinion for International Application No. PCT/US/2014/053613 dated Dec. 18, 2014, 13 Pages.
WIPO, International Search Report and Written Opinion for International Application No. PCT/US2011/001039 dated Oct. 5, 2011, 14 Pages.
WIPO, International Search Report and Written opinion for International Application No. PCT/US2015/047383 dated Jan. 12, 2016, 14 Pages.
WIPO, International Search Report and Written opinion for International Application No. PCT/US15/47536 dated Dec. 4, 2015, 17 Pages.
European Search Report received for POT 14891125.8-1604/3011122 dated Jul. 8, 2016, 4 pages.
WIPO, International Search Report and Written opinion for International Application No. PCT/US/2014/053616 dated Dec. 17, 2014, 9 Pages.
WIPO, International Search Report and Written Opinion for PCT Application No. PCT/US2011/001039 dated Oct. 5, 2011, 9 Pages.
"Beam to column connection", TATA Steel, http://www.tatasteelconstruction.com/en/reference/teaching_resources/architectural_studio_reference/elements/connections/beam to column connections, 2014, 4 Pages.
"Emerging Trends 2012 Executive Summary", Urban Land Institute, Ch. 1, 2011, 1-11 Pages.
"Emerging Trends in real estate", accessed on Sep. 15, 2016 at https://web.archive.orglweb120140813084823/http://pwc.corn.au/industry/real-estate/assets/Real-Estate-2012-Europe-Jan12.pdf, pp. 60 (2012).
"Extended European Search Report for European Application No. Ep 15836516.3", dated Jun. 22, 2018, 1 page.
"Extended European Search Report for European Patent Application No. 14900469", dated Mar. 20, 2018, 1-8.
"How to Soundproof a Ceiling—Soundproofing Ceilings", http://www.soundproofingcompany.com/soundproofing-solutions/soundproof-a-ceiling/, Apr. 2, 2014, 1-7 Pages.
"Insulspan Installation Guide", Obtained at: http://www.insuispan.comidownloads:InstallationGuide,pdf on Feb. 2, 2016, 58 pages.
"Structural Insulated Panel", Wikipedia, http://www.en.wikipedia.org//wiki/Structural_insulated_panel, May 30, 2014, 5 Pages.
"Structural Insulated Panels", SIP Solutions, http://www.sipsolutions.com/content/structuralinsulated-panels, Aug. 15, 2014, 3 pages.
"US Apartment & Condominium Construction Forecast 2003-2017", Statista, Inc., Jun. 2012, 8 Pages.
Azari, et al., "Modular Prefabricated Residential Construction—Constraints and Opportunities", PNCCRE Technical Report #TR002, Aug. 2013, 90 Pages.
Borzouie, Jamaledin, et al., "Seismic Assesment and Reahbilitation of Diaphragms", http://www.nosazimadares.ir/behsazi/15WCEE2012/URM/1/Roof.pdf, Dec. 31, 2011, 86 Pages.
EPO, Communication Pursuant to Article 94(3) EPC mailed for EP application No. 15836516.3, dated Apr. 25, 2019, 4 pages.
EPO, Communication Pursuant to Article 94(3) EPC for European Patent Application No. 15836516.3, dated Aug. 2, 2019, 4 pages.
EPO, Communication Pursuant to Article 94(3) EPC mailed for European patent application No. 14900469.9, dated Jun. 18, 2019, 5 pages.
Framecad, "FC EW 1-12mm Fibre Cement Sheet + 9mm MgO Board Wall Assembly", 2013, 2 pages.
Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, 2006, 1-15 Pages.
Gonchar, "Paradigm Shift—Multistory Modular", Architectural Record, Oct. 2012, 144-148 Pages.
Kerin, et al., "National Apartment Market Report—2013", Marcus & Millichap, 2013, 1-9 pages.
M.A. Riusillo, "Lift Slab Construction: Its History, Methodology, Economics and Applications", ACI—Abstract, Jun. 1, 1988, 2 pages.
McIlwain, "Housing in America—The Next Decade", Urban Land Institute, 2010, 1-28 Pages.
McIlwain, "The Rental Boost From Green Design", Urban Land, http://urbanland.uli.org/sustainability/the-rental-boost-from-green-design/, Jan. 4, 2012, 1-6 Pages.
Shashaty, Andre, "Housing Demand", Sustainable Communities, Apr. 2011, 14-18 Pages.
Sichelman, "Severe Apartment Shortage Looms", Urban Land, http://urbanland.uli.org/capital-markets/nahb-orlando-severe-apartment shortage-looms/, Jan. 13, 2011, 1-2 Pages.
Stiemer, S F, "Bolted Beam-Column Connections", http://faculty.philau.edu/pastorec/Tensile/bolted_beam_column_connections.pdf, Nov. 11, 2007, 1-16 Pages.
WIPO, International Search Report for International Patent Application No. PCT/US2017/021174, dated Jun. 26, 2017, 11 pages.
WIPO, International Search Report for International Patent Application No. PCT/US2017/021168, dated May 19, 2017, 5 pages.
WIPO, Written Opinion for International Patent Application No. PCT/US2017/021174, dated Jun. 26, 2017, 6 pages.
WIPO, International Search Report of International Patent Application No. PCT/US2017/021177, dated Jun. 5, 2017, 8 pages.
WIPO, Written Opinion of International Patent Application No. PCT/US2017/021177, dated Jun. 5, 2017, 8 pages.
WIPO, Written Opinion for International Patent Application No. PCT/US2017/021168, dated May 19, 2017, 8 pages.

(56) References Cited

OTHER PUBLICATIONS

WIPO, International Search Report and Written Opinion mailed for International application No. PCT/US2014/053614 dated Dec. 18, 2014, 11 pages.
WIPO, International Search Report and Written Opinion mailed for International application No. PCT/US2014/053615 dated Dec. 17, 2014, 11 Pages.
WIPO, International Search Report and Written Opinion mailed for International application No. PCT/US2019/031370, dated Aug. 7, 2019, 11 pages.
WIPO, International Search Report and Written Opinion mailed for International application No. PCT/US2014/053613 dated Dec. 18, 2014, 13 pages.
WIPO, International Search Report and Written Opinion mailed for International application No. PCT/US2015/047536 dated Dec. 4, 2015, 17 Pages.
WIPO, International Search Report and Written Opinion mailed for International application No. PCT/US2014/053616 dated Dec. 17, 2014, 9 Pages.
USPTO, International Search Report for International Patent Application No. PCT/US2017/021179, dated May 25, 2017, 7 pages.
USPTO, Written Opinion for International Patent Application No. PCT/US2017/021179, dated May 25, 2017, 7 pages.

* cited by examiner

PRE-ASSEMBLED WALL PANEL FOR UTILITY INSTALLATION

CROSS-REFERENCE TO RELATED APPLICATIONS

The present application is a U.S. National Stage filing under 35 U.S.C. § 371 of International Application No. PCT/US2017/021179, filed on Mar. 7, 2017, which claims priority under 35 U.S.C. § 119(e) to U.S. Provisional Application No. 62/304,862, filed on Mar. 7, 2016, both of which are incorporated by reference, in their entirety, for any purpose.

BACKGROUND

The construction industry is increasingly using modular construction techniques to improve efficiency. In modular construction, entire structures or subassemblies of the structure are prefabricated in an off-site facility. The completed assemblies are then transported to the construction site for installation. Although the structure of the components may be prefabricated, additional components may require installation at the construction site. These components may include electrical wiring, plumbing, data lines, and finishing surfaces. Installation for some of these components may require skilled tradespeople. Requiring tradespeople to travel to multiple construction sites rather than a single prefabrication facility may increase labor costs and reduce time efficiencies.

SUMMARY

An example pre-assembled wall panel may include a panel frame which includes a plurality of studs and first and second end members, the first end member disposed at one end of the studs and the second member disposed at opposite end of the studs, each of the plurality of studs connected to the first and second end members. The wall panel may further include a first wall board connected to a first side of the panel frame and a second wall board connected to a second side of the panel frame opposite the first side. The wall panel may further include a plurality of spacers attached to at least one of the first wall board and the second wall board, each spacer of the plurality of spacers configured to support a finish panel in a spaced relation from the at least one of the first wall board and the second wall board. The wall panel may further include a pipe disposed between the first and second wall boards and extending between the opposing end members, wherein the pipe include a pipe diverter, and wherein a free end of the pipe diverter passes through an opening in the first wall board or the second wall board.

A multi-story building may include a structural frame including at least one beam, and a pre-assembled wall panel attached to the structural frame and including an upper panel portion which extends above a floor level of an upper unit of the building and a lower panel portion which extends below a ceiling level of a lower unit of the building.

A method of constructing a utility wall of a building may include attaching a first pre-assembled wall panel to a structural frame of a building, positioning a second pre-assembled wall panel vertically above the first pre-assembled wall panel, wherein each of the first and second pre-assembled wall panels includes a pipe at least partially inside the wall panel and a flow diverter exposed to an exterior of the wall panel, attaching the second pre-assembled wall panel to the structural frame of the building, and connecting a pipe fitting to each of the flow diverters to fluidly couple the pipes of the first and second pre-assembled wall panels.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1A:
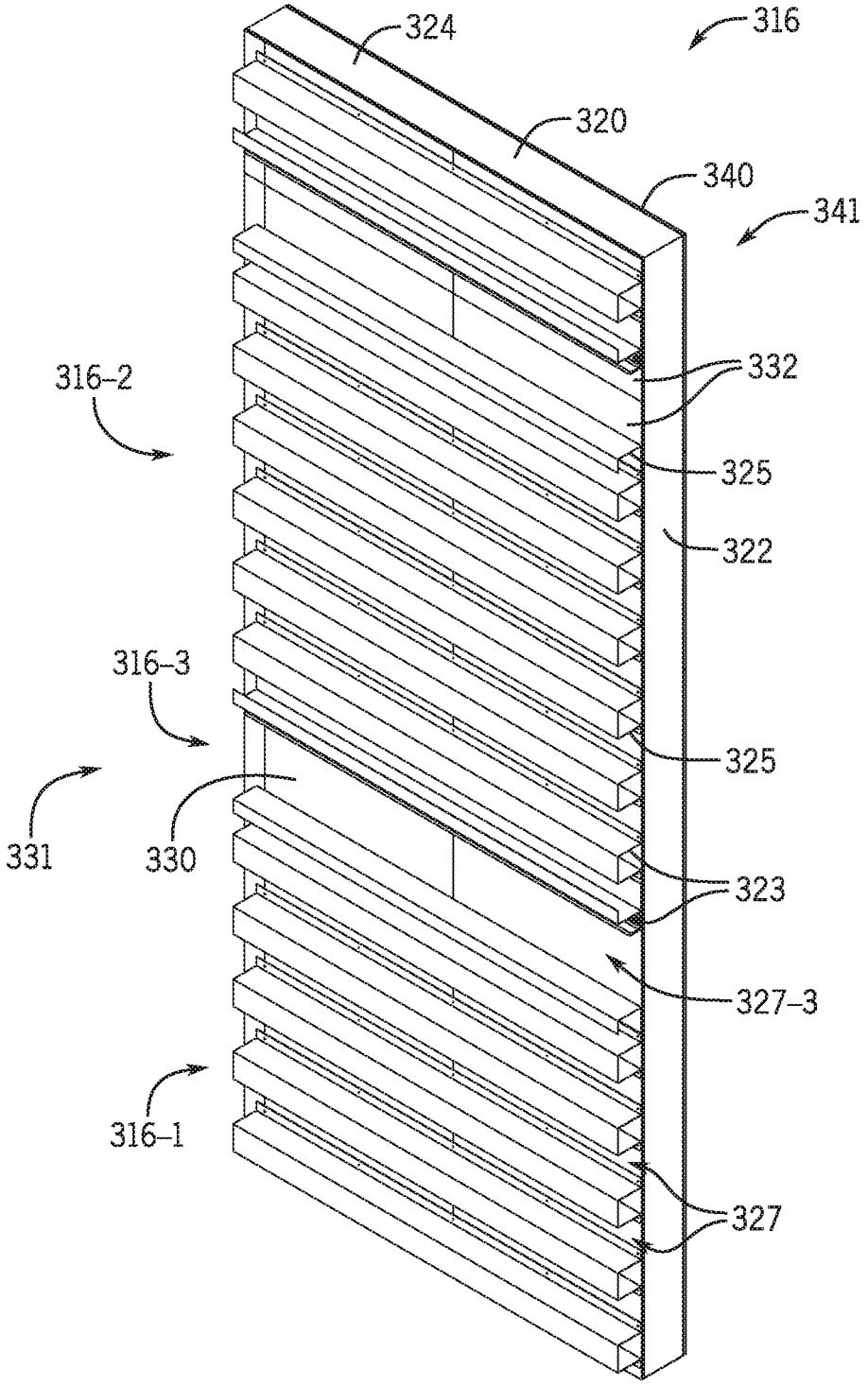
FIG. 1A is an isometric view of a wall panel.

all arranged in accordance with at least some embodiments of the present disclosure.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatuses generally related to a utility panel that may include an exterior panel, a plurality of studs coupled to the exterior panel, a hat channel coupled to the plurality of studs opposite the exterior panel, wherein the hat channel is perpendicular to the studs, and an interior panel coupled to the hat channel opposite the plurality of studs.

In some embodiments, a building may have utilities installed such as plumbing and/or electrical wiring. In some embodiments, components associated with one or more utilities may be integrated into a pre-assembled panel. For example, plumbing components, such as pipes, may be integrated into a pre-assembled wall panel. In some embodiments, when the building is being constructed, pre-assembled panels may be installed. A pre-assembled panel may provide an exterior wall of the building and an interior wall of the building. In some examples, one side of the pre-assembled panel may provide the interior wall and an opposite side may provide the exterior wall. In some examples, both sides of the pre-assembled panel may provide interior walls. In some embodiments, multiple pre-assembled panels may be coupled together to form one or more entire walls of the building. In some embodiments, the pre-assembled panels may be load-bearing and may provide support for a floor, a roof, and/or other interior or exterior walls. In some embodiments, the pre-assembled panels may be non-load bearing. In some embodiments, the pre-assembled panels may be coupled to a load-bearing structure (e.g., structural frame) of the building. For example, the load-bearing structure may be an external construction steel frame.

In some embodiments, one or more of the pre-assembled panels may have utilities pre-installed. Utilities may include electrical, plumbing, heating and air conditioning, telecommunications and/or other utilities. The pre-assembled panels with pre-installed utilities may be referred to as utility wall panels or just wall panels. The wall panels may have one or more utilities pre-installed. Installing the utilities during fabrication of the wall panel prior to delivery to a building construction site may allow for faster assembly of the building and may reduce the number of skilled tradespeople required for installation of utilities in the building in some embodiments.

In some embodiments, multiple wall panels may be coupled together. The wall panels may be coupled together horizontally and/or vertically. The utilities within the panels may also be coupled together horizontally and/or vertically. This may allow utilities to be provided to multiple units on a story and to multiple units on multiple stories of the building.

In some embodiments, the wall panels may include two wall boards with an interstitial space between them. In some embodiments, the wall boards may be attached to opposite sides of a plurality of studs, which may maintain the interstitial space between the wall boards. The plurality of studs may be joined to opposing first and second end members to form a panel frame. The first end member may be disposed at one end of the studs and the second end member may be disposed at the opposite end of the studs. Each of the studs in the plurality of studs may be connected to the first and second end members. The studs may be spaced from one another. Utilities may be installed within the interstitial space and between the studs. In some embodiments, the studs may be punched, which may allow utilities to be installed through the openings in the studs. In some embodiments, the wall panel may include spacers attached to exterior surfaces of the wall board, such as for attaching wall finish materials. The wall finish materials may include internal or external finishes such as interior finish panels or exterior cladding. The spacers may provide the finish materials in a spaced relation with respect to the wall boards, thereby defining a space between the finish material and the wall boards. The space may be used to for utilities, such as for making connections between utility components of one panel to those of another panel.

In some embodiments, pipes for plumbing and/or other utilities may run vertically inside the wall panels. In some examples, the pipes may run between the studs. In some embodiments, the pipes may be surrounded by foam. In some embodiments, the foam may substantially fill the space between the studs and the wall boards. In some embodiments, the foam may at least partially support the pipes. In some embodiments, the foam may hold the pipes in alignment. In some embodiments, the wall panel may include insulation, such as mineral wool. In some embodiments, the insulation may be provided between the studs.

In some embodiments, the material composition of a panel frame of the wall panel may be predominantly metal, such as steel. In some embodiments it may be predominately aluminum. In still other embodiments, the wall panel components may be made from a variety of building suitable materials ranging from metals and/or metal alloys, to wood and wood polymer composites (WPC), wood based products (lignin), other organic building materials (bamboo) to organic polymers (plastics), to hybrid materials, or earthen materials such as ceramics. In some embodiments cement or other pourable or moldable building materials may also be used. In other embodiments, any combination of suitable building material may be combined by using one building material for some elements of the utility panel and other building materials for other elements of the utility panel. Selection of any material may be made from a reference of material options (such as those provided for in the International Building Code), or selected based on the knowledge of those of ordinary skill in the art when determining load bearing requirements for the structures to be built. Larger and/or taller structures may have greater physical strength requirements than smaller and/or shorter buildings. Adjustments in building materials to accommodate size of structure, load and environmental stresses can determine optimal economical choices of building materials used for all components in the utility panel described herein. Availability of various building materials in different parts of the world may also affect selection of materials for building the system described herein. Adoption of the International Building Code or similar code may also affect choice of materials.

Any reference herein to "metal" includes any construction grade metals or metal alloys as may be suitable for fabrication and/or construction of the utility panel and components described herein. Any reference to "wood" includes wood, wood laminated products, wood pressed products, wood polymer composites (WPCs), bamboo or bamboo related products, lignin products and any plant derived product, whether chemically treated, refined, processed or simply harvested from a plant. Any reference herein to "concrete" includes any construction grade curable composite that includes cement, water, and a granular aggregate. Granular aggregates may include sand, gravel, polymers, ash and/or other minerals.

Figure 1B:
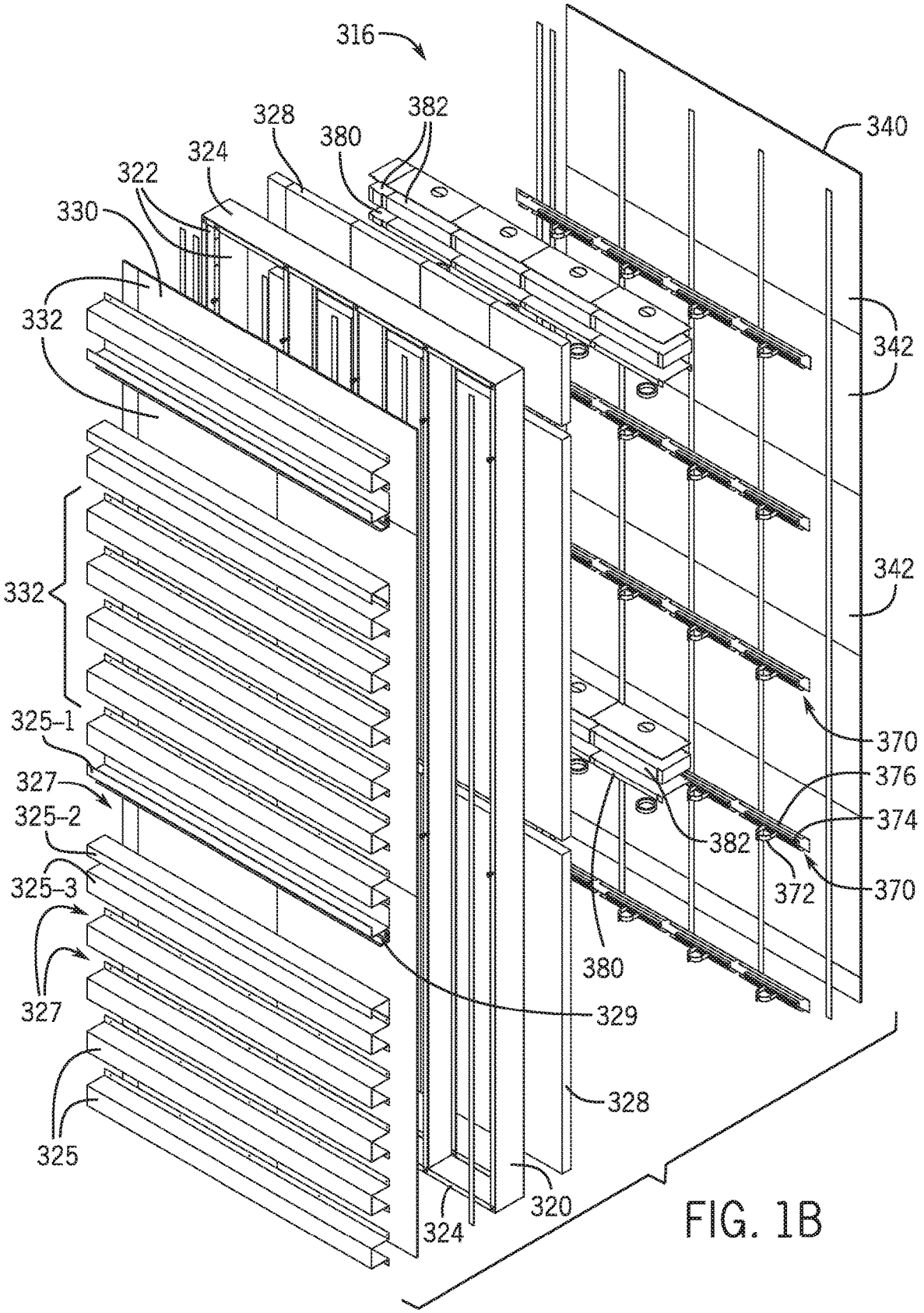
FIG. 1B is a partially exploded isometric view of the wall panel in FIG. 1A.

Turning now to the drawings, FIGS. 1A and 1B show illustrations of an isometric and a partially exploded view of an example utility panel 316, arranged in accordance with at least some embodiments described herein. FIG. 1A shows, among other things, a panel frame 320, studs 322, end members 324, first and second wall boards 330 and 340 respectively, insulation 338, pipe support member 370 and spacers 323 of utility panel 316. FIG. 1B shows, among other things, panel frame 320, studs 322, end members 324, first and second wall boards 330 and 340 respectively, interstitial spaces 326, insulation 338, spacers 323, cavities 327, and pipe support member 370 of utility panel 316. The various components shown in FIGS. 1A and 1B are merely embodiments, and other variations, including eliminating components, combining components, and substituting components are all contemplated.

The pre-assembled wall panel 316 may include a panel frame 320 which may include a plurality of studs 322 and end members 324. The end members 324 may be positioned at opposite ends of the studs 324 and connected thereto. The studs 322 may be formed from a metallic material such as aluminum or steel in some embodiments. In some embodiments, the studs 322 may be from about 8 inches deep to about 12 inches deep. In some embodiments, the studs 322 may be about 10 inches deep. When the wall panel 316 is installed in a building, the studs 322 may extend vertically. In some embodiments, the studs 332 may be regularly or irregularly spaced. In some embodiments, the studs 322 may be spaced at two foot on center. The spacing of the studs may be adjusted based on the load requirements of the structure. In some embodiments, the studs may be implemented using wooden studs. Any other suitable construction material (e.g., fiber-reinforced composite material) may be used in some embodiments. In some embodiments, openings may be present in the studs 322 which may allow for horizontal distribution of utilities. The studs 322 may define vertical interstitial spaces 326 between the studs 322 for vertical distribution of utilities and openings in the studs 322 may allow for connections between utilities in adjacent vertical interstitial spaces 326. Insulation 328 may be provided in one or more of the interstitial spaces 326 between the studs 322. The studs 322 may be connected to opposing end members 324, which collectively with the outer studs may define perimeter sides of a wall panel 316. During assembly, wall panels 316 may be provided side to side (e.g., vertically or horizontally adjacent to another panel). In some examples, perimeter sides of adjacent wall panels may abut one another. In some examples, intermediate layers may be disposed between adjacent sides of the wall panels. In some examples, interfacing components or assemblies, for examples for sealing the joint between adjacent panels, may be provided between adjacent sides of the wall panels.

A first wall board 330 and a second wall board 340 may be connected to opposite sides of the panel frame 220. For example the wall boards may be fastened (e.g. using threaded fasteners) to opposite sides of the studs 322 and opposing members 324. The first and/or second wall boards may be constructed from one or more pre-manufactured boards 332, 342 of non-combustible material. As will be understood by those skilled in the art, a non-combustible material may be a material which may not readily ignite, burn, support combustion or release flammable vapors when subjected to fire or heat. Examples of non-combustible materials include inorganic mineral materials such as cement, gypsum, and magnesium oxide as may be typically used in interior and exterior sheathing products. Other examples may include glass, glass fibers or glass/fiberglass cladding, which may be used in combination with an inorganic mineral product, for example for reinforcing a core or for lining sides of a core formed of an inorganic mineral product. In still other embodiments, the wall panel or components thereof may be made from a variety of other building suitable materials.

In some embodiments, the first wall board 330 may be provided on a first side 331, which may function as an interior wall of a building. The second wall board 340 may be provided on a second opposite side 341, which may function as an exterior wall of the building. The wall panel 316 may be configured to support a finish material on one or both of the first and second sides 331, 341 respectively. In some embodiments, spacers 323 may be attached to either or both of the first and second wall boards 330, 340. The spacers 323 may be configured to support a finish panel, which may be an interior finish panel or an exterior finish panel. The spacers 323 may be configured to attach the finish panel in a spaced relation with respect to a wall board. The finish panel may be an interior finish panel, such as wood, laminate, tile, metal, plastic, composite or others type of panel. The finish panel may be attached to the spacer, such as by mechanically fastening it to the spacer. In some examples, the finish panel may be bonded (e.g., permanently or removably adhered). In some examples, the finish panel may be removably attached, such as being attached in a manner in which the removal of the finish panel would not cause substantial damage to the wall panel and/or finish panel. In some examples, the finish panel may be an exterior finish panel such as exterior cladding, which may be provided on an exterior wall.

In some embodiments, a spacer 323 may be implemented in the form of an elongate member 325, which may extend continuously along a length of the wall panel 316. The spacer 323 may have a length 1. In some examples, a spacer 323 may extend the full length of the panel 316 or a part of the length of the panel 316. The spacer 323 may have a height h, which may define the spacing distance d between a wall boards (e.g., wall board 330) and a finish panel when a finish panel is attached thereto. The height and length of a spacer of a wall panel may be varied as suitable for a particular application. Spacers may be provided on one or both sides of the wall panel. For example, spacers may be provided on an interior side, such as to attach one or more interior finish panels thereto. In some examples, spacers (e.g., hat channels or furring channels) may be provided on an exterior side of a wall panel, such as to attach one or more exterior finish panels thereto. In some examples, the spacers on an exterior side of a wall panel may be attached in the field. In some examples, the spacers on an exterior side of a wall panel may be attached in the factory and may form part of the pre-assembled wall panel.

A plurality of spacers 323 (e.g., elongate members 325) may be provided along an exterior surface of a wall board. The spacers (e.g., elongate members 325) may be generally parallel (e.g., plus or minus 15 degrees) to one another. When the wall panel 316 is installed, the spacers 323 (e.g., elongate members 325) may extend substantially horizontally. The spacers 323 (e.g., elongate member 325) may be spaced apart from one another to define horizontally extending cavities 327 therebetween. The horizontally extending cavities 327 may accommodate utility components behind the finish panels. In some embodiments, the spacers 323 may be implemented using a plurality of shorter brackets, which may be arranged in line along an exterior surface of a wall board. In some embodiments the spacers 323 may include one or more hat channels 325-3. The hat channels 325-3 may be arranged perpendicularly (e.g., plus or minus 15 degrees) to the studs 322, on opposite sides of a wall board (e.g., wall board 330). In some embodiments, the spacers 323 may include one or more C-shaped or J-shaped channels 325-1, 325-2. In further embodiments, the spacers may include brackets having a different cross-sectional shape. Wall panels and/or components thereof may be attached to other structures or components using various techniques such as by mechanically fastening, such as with rivets, threaded fasteners (e.g., screws, bolts, nut and bolt combinations, and the like), or other types of mechanical fasteners. In some examples, components may be bonded (e.g., adhered or glued) to other components. Various techniques for joining components may be used without departing from the scope of the present disclosure.

Figure 7:
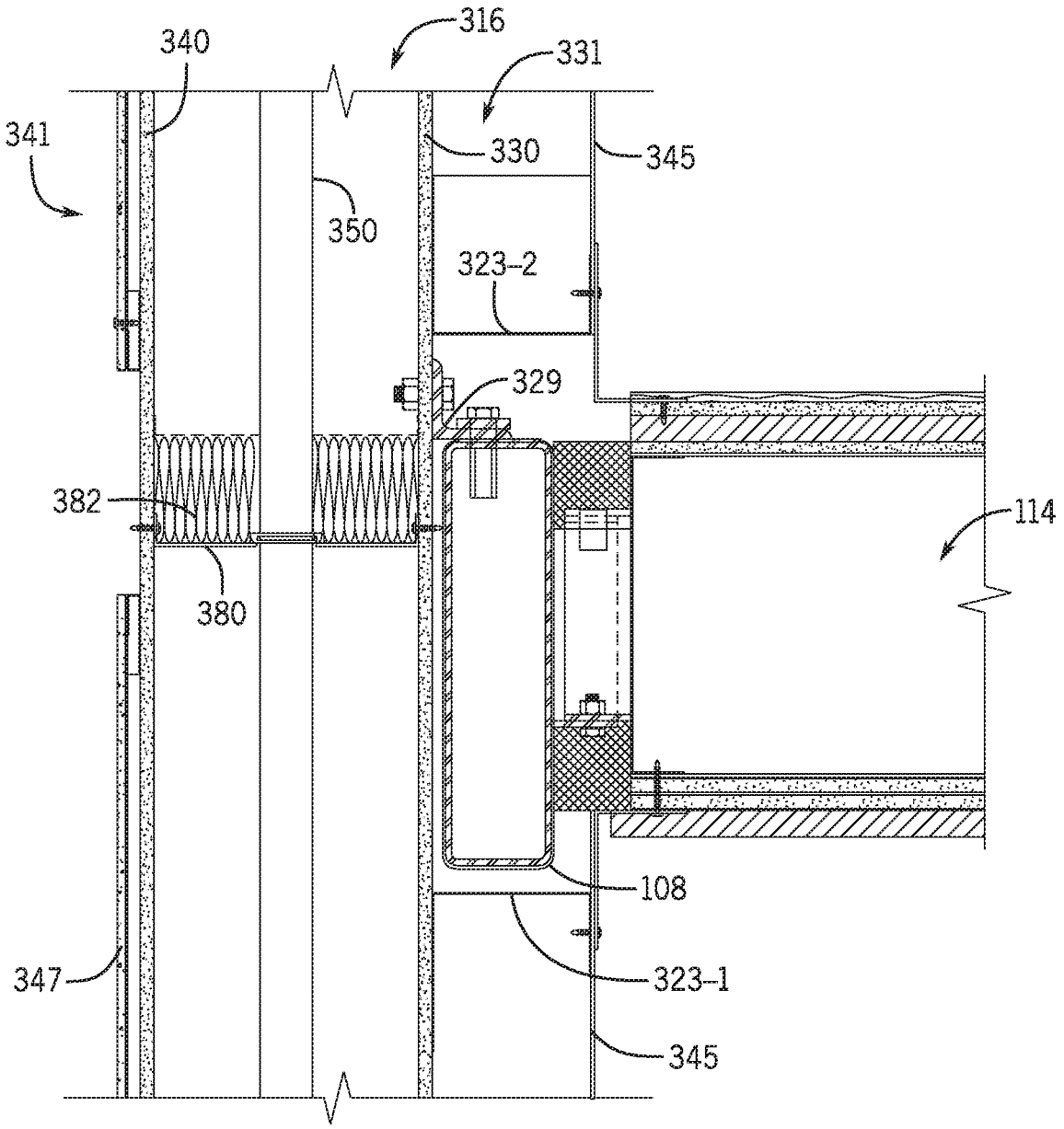
FIG. 7 is an elevation cross-sectional view of a wall panel attached to other structure of a building.

The wall panel 316 may include a lower panel portion 316-1 and an upper panel portion 316-2. When the wall panel 316 is installed, the lower panel portion 316-1 may span the height of at least part of a lower story of a building. The upper panel portion 316-2 may span the height of at least part of an upper story of the building, and in some examples, it may span more than one story of the building. At least some of the spacers 323 may be further spaced apart than other spacers. In some examples, at least some of the spacers may be spaced sufficiently far apart to define a cavity 327-3 configured to accommodate other structure, such as a floor panel or a horizontal member (e.g., a beam) of the structural frame of a building. The cavity 327-3 may be located at a story delineation portion 316-3 of the wall panel 316. The story delineation portion 316-3 may be between the lower and upper portions 316-1, 316-2 of the wall panel. In some examples, the wall panel 316 may include multiple story delineation portions, each of which may be configured to be joined to other structure. In some examples, a bracket 329 may be attached to the story delineation portion 316-3. The bracket 329 may be used to align and/or join the wall panel 316 to the other structure (e.g., beam or floor panel as shown in FIG. 7). The bracket 329 may have an L-shaped cross-section. The bracket 329 may be implemented in the form of an angle bracket, such as an angle iron. The bracket 329 may be differently shaped or formed of a material other than metal.

The wall panel 316 may include a reinforcing member 380 in an interior of the wall panel 316. The reinforcing member 380 may be arranged horizontally when the wall panel 316 is installed in a building, and thus may be interchangeably referred to as horizontal reinforcing member. The reinforcing member may be implemented in the form of a plate, for example a metal plate (e.g., a steel plate). The reinforcing member 380 may be proximate to the cavity 327-3. The reinforcing member 380 may be disposed between the wall boards 330, 340 on an opposite side of a wall board from the cavity 327-3. The reinforcing member 380 may abut each of the wall boards. The reinforcing member 380 may be in the story delineation portion 316-3 of wall panel 316, and may function to stiffen the wall panel in the thickness direction particularly at locations where the panel may abut other structure, such as a beam or a floor panel. Insulation 382 may be provided below or over the reinforcing member 380. The insulation 382 may include mineral wool and may be arranged perpendicularly (e.g., plus or minus 15 degrees) to the wall boards.

In some embodiments, pipes (see e.g., pipe 350 in FIG. 2) may be disposed between the wall boards of a wall panel. When a wall panel is installed, the pipes may run vertically between the studs 322. For clarity of illustration, the pipes have been omitted from the exploded view in FIG. 1B so as not to clutter the illustration. It will be understood that wall panel 316 or any other embodiments of wall panels in accordance with the present disclosure may include one or more pipes. In some examples, the wall panel 316 may include a plurality of pipes, such as water pipes (e.g., hot and cold water supply lines) and drain pipes. The pipes may extend between the opposing end members 324. The pipes may include at least one pipe diverter, and in some examples a plurality of pipe diverters. The pipe diverter may be configured to split a flow path of the pipe. In some examples, the pipe diverter may be configured to redirect at least a portion of a fluid in a pipe. In some examples, and depending on the type of pipe (e.g., water supply pipe or a drain pipe), the pipe diverter may be configured to direct another flow path into the pipe. The pipe diverter may include any structure that is operable to combine two or more flow paths into fewer flow paths, or one which is operable to split a flow path into a plurality of flow paths. In some examples, the pipe diverter may include a pipe fitting connected to or integrally formed with a section of the pipe. In some examples, the pipe diverter may include a T-shaped element (e.g., a T-shaped pipe section). In some examples, the pipe diverter may include a Y-shaped element (e.g., a Y-shaped pipe section).

A free end of the pipe diverter may extend through the wall panel. For example, the free end of the pipe diverter may pass through an opening in one of the wall boards, exposing the free end to an exterior of the wall panel to enable connections to other plumbing components. A pipe diverter may include a pipe fitting such as a tee fitting or a wye fitting. In some examples, the pipe diverter may be connected to separate pipe sections that form the pipe or it may be integrally formed with a pipe section. In some examples, the ends of the pipes may be capped and enclosed within the panel frame. Fluid connections between pipes of vertically adjacent panels may be formed using the pipe diverters as will be described further below.

The wall panel 316 may further include a pipe support member 370. The pipe support member 370 may be connected to the panel frame 320 and may operably engage a pipe (e.g., pipe 350 in FIG. 2). The pipe support member 370 may thus connect the pipe to the structure of the wall panel so as to reduce movement of the pipe, for example during transport and installation of the wall panel 316. The pipe support member 370 may be arranged transversely to the studs 322. In some examples, the pipe support member 370 may extend substantially perpendicularly (e.g., plus or minus 15 degrees) to a stud. In some embodiments, a plurality of pipe support members 370 may be included. The pipe support members may include a pipe bracket 372. The pipe bracket 372 may be attached to a transverse member 374. The transverse member 374 may be implemented using a C-shaped channel (e.g., a metal C-channel) and the pipe bracket 372 may be operatively coupled to the C-shaped channel. In some example, the transverse member 374 may be implemented using a UNISTRUT channel from Atkore International, Inc. The pipe bracket may be implemented using a conduit clamp configured for use with a UNISTRUT channel. In some example, different transverse members and pipe brackets may be used. In some examples, a plurality of transverse members 374 may be attached (e.g., fastened or welded) to a track 376 and the track may be used to connect multiple transverse members 374 to one or more studs 322. In some examples, the track 376 may extend transversely across multiple interstitial spaces 326 to connect to a plurality of studs 322. The track 376 may extend the full distance between the outer studs. In some examples, the base of the track 376 may be directly against the studs and the transverse members 374 may be received in an interstitial space 326 between two adjacent studs 322. The wall panel 316 may include a plurality of pipe support members for supporting a plurality of pipes. Different sizes of pipe brackets may be used to attach different diameter pipes to the panel frame.

Figure 2:
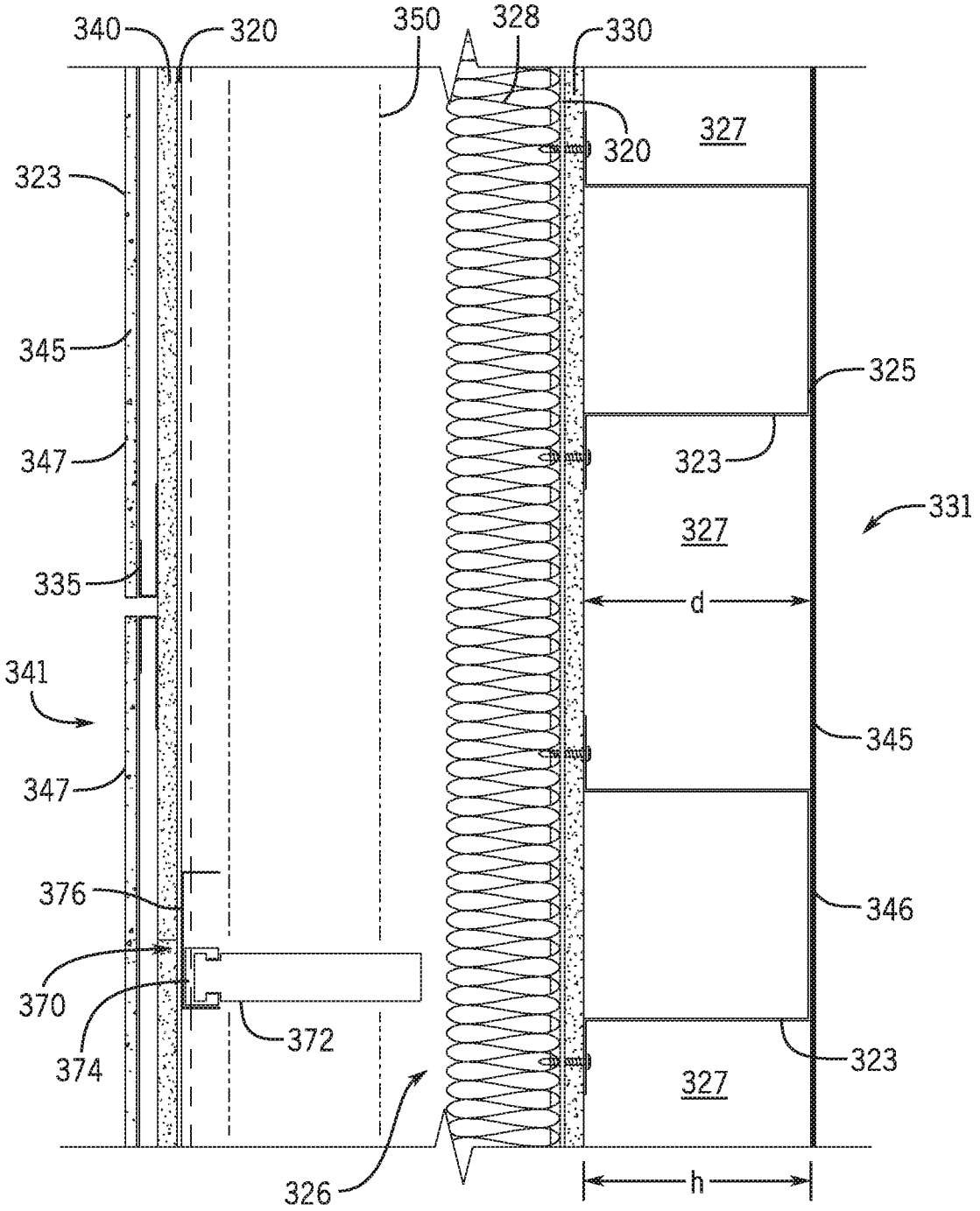
FIG. 2 is a partial elevation cross-sectional view of a wall panel.

FIG. 2 is a partial cross-sectional view of wall panel 316 in accordance with further examples of the present disclosure. FIG. 2 illustrates an example wall panel (e.g., wall panel 316) after installation in a building and show finish panels attached thereto. FIG. 2 shows a portion of wall panel 316, panel frame 320, interstitial space 328, insulation 328, wall boards 330, 340 provided on sides 331 and 341, respectively, spacers 323 including elongate members 325 and 335, cavities 327, height h of spacers 323 and spacing distance d associated with cavities 327, finish panels 345 including interior finish panel 346 and exterior finish panel 347, pipe 350, pipe support member 370, transverse member 374, pipe bracket 372 and track 376. The various components shown in FIG. 2 are merely embodiments, and other variations, including eliminating components, combining components, and substituting components are all contemplated.

As illustrated, after wall panel 316 is installed, finish panels 345 may be attached to one or both sides of the wall panel. The wall panel 316 may include spacers 323 attached to one or both of the wall boards 330, 340. The spacers may be implemented using elongate members having closed (e.g., box-shaped) or open (e.g., hat channel, C-channel, J-channel or others) cross-sections. The height of the spacers may define a dimension d of the cavities 337. In some examples, spacers having different heights may be used on each side of the wall panel. For example, the height of the elongate members 325 on side 331 of the wall panel 316 may be greater than the height of the elongate members 335 on side 341 of the wall panel 316. Side 331 may provide an interior wall and interior finish panels 346 may be attached to the elongate members 325. Side 341 may provide an exterior wall and exterior cladding 347 may be attached to the elongate members 335. In such examples, additional layers may be provided between the wall board 340 and the spacers 323 on side 341. For example, a weather-resistive barrier may be disposed (e.g., bonded) to an exterior surface of wall board 340 and the elongate members 335 may be arranged over the weather-resistive barrier.

Figure 3:
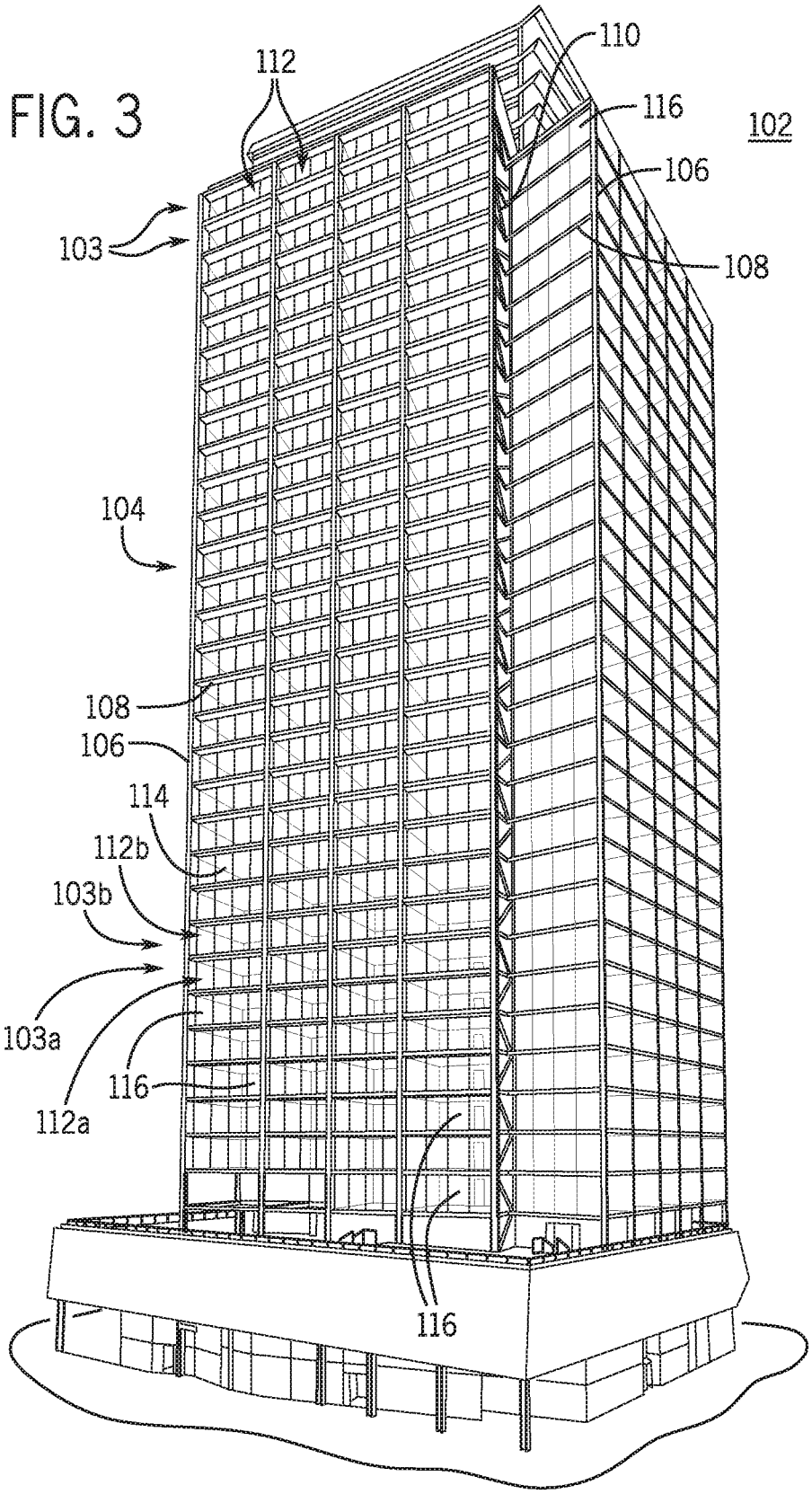
FIG. 3 is an illustration of a multi-story building.

FIG. 3 illustrates an example multi-story building 102, arranged in accordance with at least some embodiments described herein. FIG. 3 shows building 102, stories 103, structural frame 104, columns 106, beams 108, cross braces 110, units 112, floor-ceiling panel 114, and walls 116. The various components shown in FIG. 3 are merely illustrative, and other variations, including eliminating components, combining components, and substituting components are all contemplated.

The building 102 may include two or more stories or levels 103. The building 102 may be classified as a low-rise, mid-rise, or high-rise construction depending on the number of stories (each city or zoning authority may define building heights in any fashion they deem proper). The building 102 may include one or more wall panels 116 which may define walls of one or more units 112 of the building 102. In some examples, one or more of the wall panels 116 may be non-load bearing and may be arranged proximate one or more elements of the building's structural frame 104. The wall panels as described herein may be suitable for use in a building of any number of stories (levels), including a mid-rise building and a high-rise building. In some embodiments, the building may be a residential multi-dwelling building having eight or more stories. In some embodiments, the building may have fifteen or more, or in some examples thirty or more stories.

The building 102 may include a structural frame 104. The structural frame 104 may include multiple columns 106, beams 108, and cross braces 110. The columns 106 may be oriented vertically, the beams 108 may be oriented horizontally, and the cross braces 110 may be oriented obliquely to the columns 106 and the beams 108. The beams 108 may extend between and be attached to adjacent columns 106 to connect the adjacent columns 106 to one another. The cross braces 110 may extend between and be attached to contiguous beams 108 and columns 106 to provide additional stiffness to the structural frame 104. In some embodiments, one or more of the walls of the building 102 may not be load bearing walls. In some embodiments, the load bearing support may be provided by the structural frame 104. The columns, beams and cross braces may be arranged to provide most or substantially all the structural support for building 102. The frame may be used to provide decoration or added support to the structure as well.

The building 102 may include multiple units or modules 112 operatively arranged relative to the structural frame 104. The units 112 may be commercial, residential (such as dwelling units), or both. The units 112 may be assembled at the building site using multiple pre-assembled or prefabricated components, such as pre-assembled wall panels, floor panels and/or others. The prefabricated components may be assembled independent of one another remotely from the building site and transported to the building site for installation. The components may be attached to the structural frame 104, to adjacent components, or both at the building site to form the individual units 112. In some embodiments, the building 102 may include internal support structures. Prefabricated components may be attached to the internal support structures in some embodiments. In some examples, the use of prefabricated components as described herein may significantly reduce the field time for constructing a building, such as building 102. Each story or level 103 of the building 102 may include one or multiple units 112 defined by the prefabricated components. The units may be standardized and repetitive, or unique and individualized. Mixed units of standard size and shape may be combined with unique units in the same floor, or in independent arrangement on separate floors. In some embodiments, a unit may encompass more than one floor.

The components may include one or more pre-assembled floor-ceiling panels 114 and one or more pre-assembled wall panels 116. The floor-ceiling panels 114 may be oriented horizontally and may define the floor of an upper unit and the ceiling of a lower unit. Individual floor-ceiling panels 114 may be arranged adjacent to one another in the horizontal direction and attached to one another, one or more columns 106, one or more beams 108, or any combination thereof. In some examples, the floor-ceiling panels may be attached to columns 106, beams 108, or combinations thereof only around a perimeter of the panels. The wall panels 116 may be oriented vertically and may provide interior (e.g., demising) and exterior (e.g., envelope) walls of the building. Interior (e.g., demising) walls may partition each story into multiple units, a single unit into multiple rooms, or combinations thereof. The wall panels 116 may be attached to the floor-ceiling panels 114 with fasteners and then caulked, sealed, or both. In some examples, the wall panels 116 are arranged proximate horizontal structural members (e.g., beams 108) and/or vertical structural members (e.g., columns 106) of the structural frame 104. In some examples, the wall panels 116 may be substantially aligned or may be offset but generally parallel with a horizontal and/or a vertical structural member.

The wall panel 316 may be used to implement a wall panel 116 in a building such as building 102. For example, the wall panel 316 may be used to construct a utility wall in a building, such as a building 102. In traditional construction, walls are typically constructed between the floor and ceiling of any given story. In some examples, a pre-assembled wall panel (e.g., wall panel 316) may be configured to span, at least partially, multiple stories of a building. For example, a pre-assembled wall panel in accordance with the present disclosure may span at least part of a lower story and at least part of an upper story. The pre-assembled wall panel may include upper panel portion which extends above a floor level of an upper unit of the building and a lower panel portion which extends below a ceiling level of a lower unit of the building. In some examples, the upper wall panel portion may span the full height of the upper story and a partial height of another story above the upper story. That is, a pre-assembled wall panel may span a full story and span a portion of the story below and a portion of the story above the story it fully spans. A vertical length of the panel when installed (e.g., a height of the panel) may be from about 18 feet to about 22 feet. A pre-assembled wall panel in accordance with some examples of the present disclosure may be up to about 21 feet high, and in some examples more than 21 feet high. A pre-assembled wall panel in accordance with some examples of the present disclosure may be configured to provide utilities, such as plumbing utilities to multiple units, for examples the units that the wall panel spans. In some examples, the wall panel may provide utilities to additional units, such as units below and/or above the units that the wall panel spans. That is, the wall panel may be configured to be attached to vertically adjacent wall panels such that utility components thereof may be operably connected.

Figure 4:
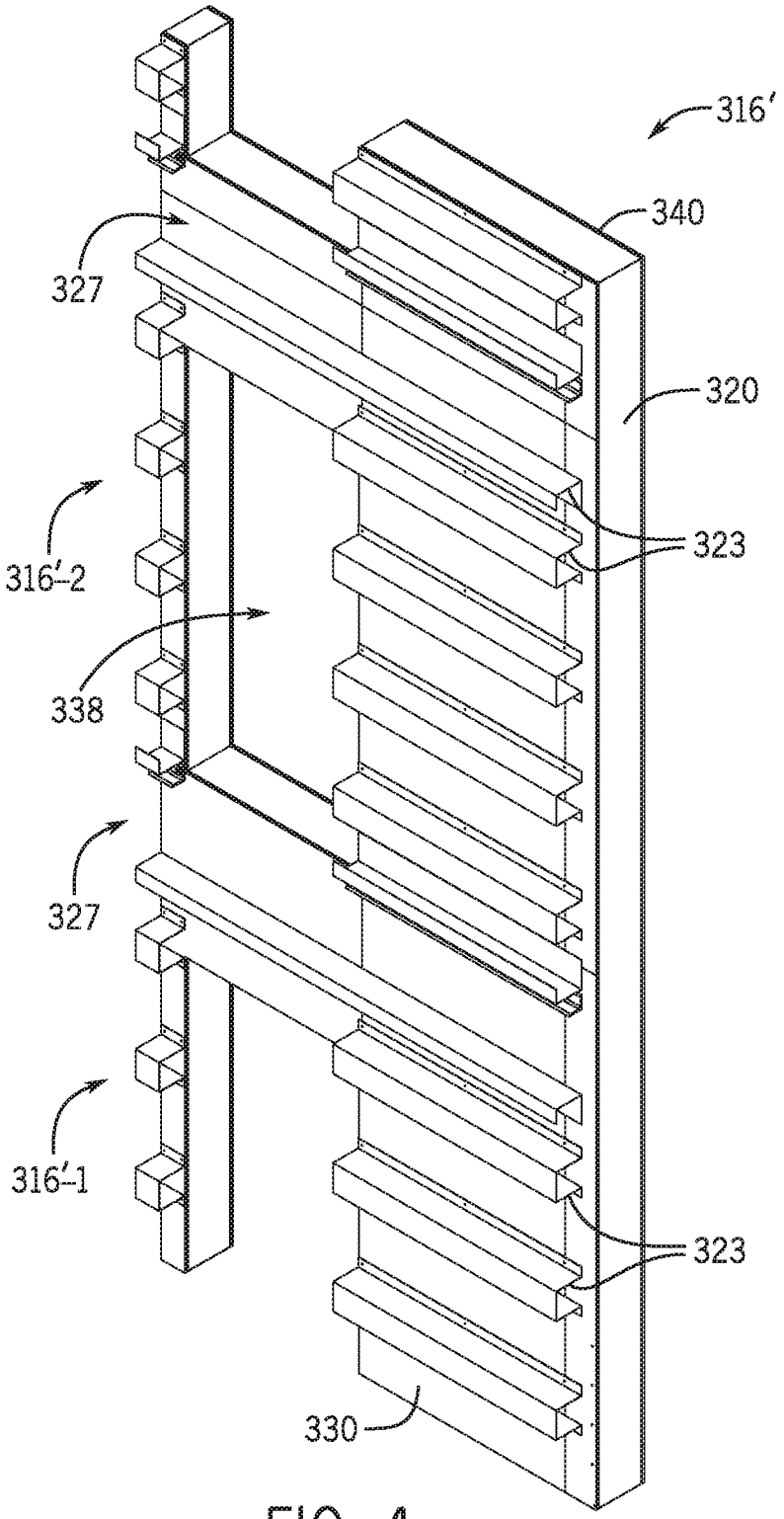
FIG. 4 is an isometric view of another wall panel.

In some embodiments, a wall panel may include ingress/egress features, for example to accommodate one or more doors or windows. FIG. 4 shows a pre-assembled wall panel 316' in accordance with some embodiments. FIG. 4 shows wall panel 316', wall boards 330, 340, panel frame 320, spacers 323, cavities 327, opening 328, and lower and upper panel portions 316'-1, 316'-2, respectively. The various components shown in FIG. 4 are merely illustrative, and other variations, including eliminating components, combining components, and substituting components are all contemplated.

The wall panel 316' may be similar to and include one or more of the components of wall panel 316, the description of all which will not be repeated for brevity. For example, the wall pane 316' may include a panel frame 320, and first and second wall boards 330 and 340, respectively. The panel frame 320 and the first and second wall boards 330 and 340 may be implemented using any of the examples herein. In this illustrated embodiment, the wall panel 316' may be configured to accommodate a door (not shown). To that end, the wall panel 316' may include an opening 338, which may be sized to receive a door (not shown). The wall panel 316' may include a lower portion 316'-1, which when the wall panel 316' is installed may span at least part of a lower unit. The wall panel 316' may include an upper portion 316'-2, which when the wall panel 316' is installed may span at least part of an upper unit. In some examples, the upper portion 316'-2 may fully span (e.g., extend the full height) of the upper unit and may further span at least part of another unit above the upper unit.

The panel 316' may include spacers 323 which may support a finish panel in a spaced relation to a wall board (e.g., wall board 330). The spacers 323 may be arranged horizontally (e.g., plus or minus 15 degrees). The spacers 323 may be regularly or irregularly spaced from one another defining horizontally extending cavities 327. One or more of the cavities 327 may be configured to accommodate therein other structure (e.g., a beam or a floor panel) when installing the wall panel 316' in a building.

Figure 5A:
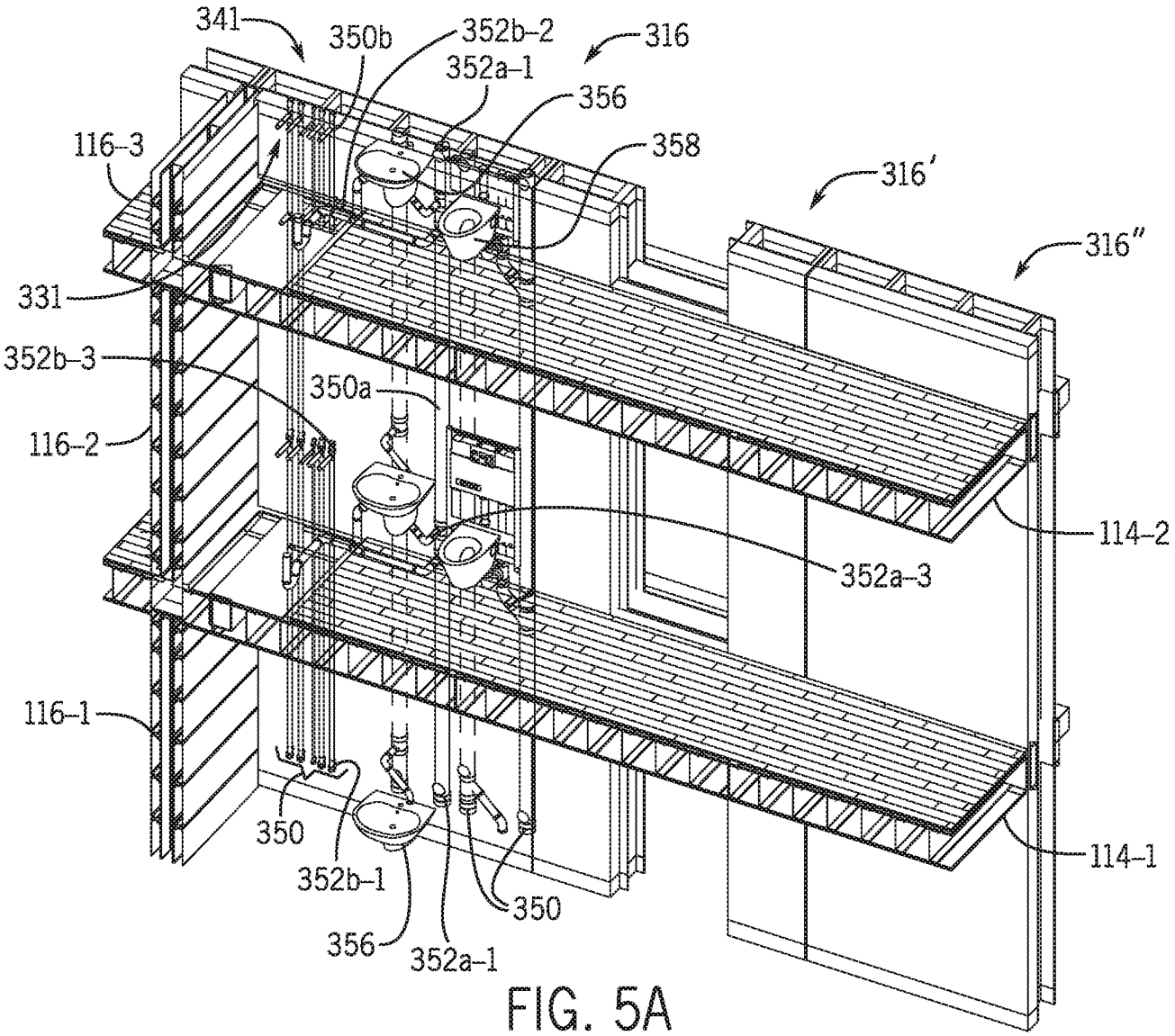
FIG. 5A is an illustration of an isometric elevation of a portion of a building.
Figure 5B:
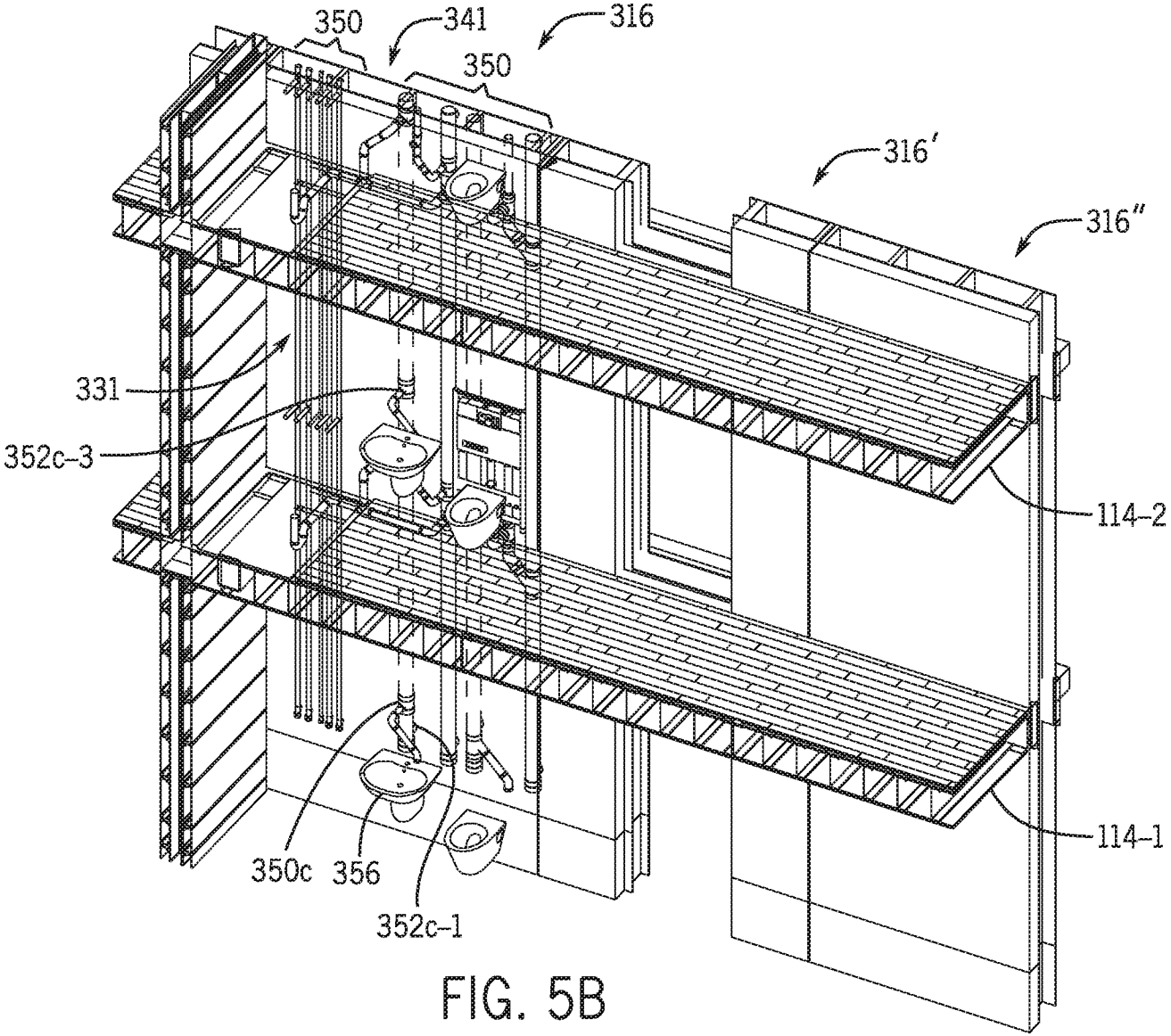
FIG. 5B is an illustration of another isometric elevation of a portion of a building.

FIGS. 5A and 5B illustrate isometric elevations of portions of a building, such as building 102. FIGS. 5A and 5B show utility wall panels 316, 316' and 316", portions of wall panels 116-1, 116-2, 116-3, portions of floor panels 114-1 and 114-2, pipes 350 drain pipe 350*a* and 350*c*, and water pipe 350*b* and exemplary plumbing fixtures (e.g., sink 356 and toilet 358). The various components shown in FIGS. 5A and 5B are merely embodiments, and other variations, including eliminating components, combining components, and substituting components are all contemplated.

Wall panels 116-1, 116-2, and 116-3 are associated with three vertically adjacent stories 112-1, 112-2, and 112-3. Floor panels 114-1 and 114-2 provide a floor and a ceiling between vertically adjacent stories. The utility wall panels 316, 316', and 316" span more than one story each. One or more of the utility wall panels 316, 316', and 316" may be configured to provide utilities for more than one story. For example, wall panel 316 may include a plurality of pipes 350 which may most of the length between the top and bottom sides of the wall panel to carry utilities to each of the stories 112-1, 112-2, and 112-3. Wall panel 316 may include drain pipes (e.g., pipe 350*a*) and water pipes (e.g., pipe 350*b*). One or more of the pipes may have one or more pipe diverters. For example, drain pipe 350*a* may include a first pipe diverter 352*a*-1, a second pipe diverter 325*a*-2, and a third pipe diverter 352*a*-3. The first pipe diverter 352*a*-1 and the second pipe diverter 325*a*-2 may be used to connect the pipe 350*a* to adjoining wall panels below or above the wall panel 316. The third pipe diverter 352*a*-3, which may be one of a plurality of intermediate pipe diverters, may be used to route utilities within the units. For example, the third pipe diverter 352*a*-3 may be used to connect a drain of a plumbing fixture (e.g., a skin, a toilet blow, a shower or bath liner).

Similarly, water pipe 350*b* may include one or more pipe diverters (e.g., pipe diverter 352*b*-1, 352*b*-2, 352*b*-3). Two of the pipe diverters (352*b*-1, 352*b*-2) may be used to connect the pipe 350*b* to respective pipes (e.g., connect hot water to hot water supply line, cold water to cold water supply line) of adjoining wall panels. Other pipe diverters of the pipe 350*b* may be used to connect plumbing fixtures (e.g., faucets, showerheads, etc.). In some examples, a pipe diverter may have an opening oriented towards an interior of a unit, such as pipe diverters 352*a*-1 and 352*a*-3 of pipe 550*a* in the example in FIG. 5A. In some examples, a pipe diverter may have an opening oriented towards an interior of a unit, such as pipe diverters 352*c*-1 and 352*c*-3 of pipe 550*c* in the example in FIG. 5A. Pipe diverters configured to connecting to interior plumbing fixtures may face inward (e.g., have openings oriented toward an interior of a unit), such as pipe diverters 352*a*-3 and 352*c*-3. The pipes 350 may include other pipe diverters which may connect one pipe within a panel to another pipe within the panel. These pipe diverters may not be exposed but may instead be substantially enclosed within the wall panel.

Connection between vertically adjoining wall panels may be formed using pipe fittings (e.g., elbows and tees). One or more pipe fittings and/or one or more pipe sections may be connected to the free ends of the pipe diverters of respective pipes of adjoining wall panels. The free end of a pipe diverter may be easily accessible as it may be exposed (e.g., passing through an opening in a wall board of the panel). A firestop collar may be provided at the opening to meet fire safety requirements. Once a pipe connection is made the connection can be concealed behind a finish panel.

Figure 6:
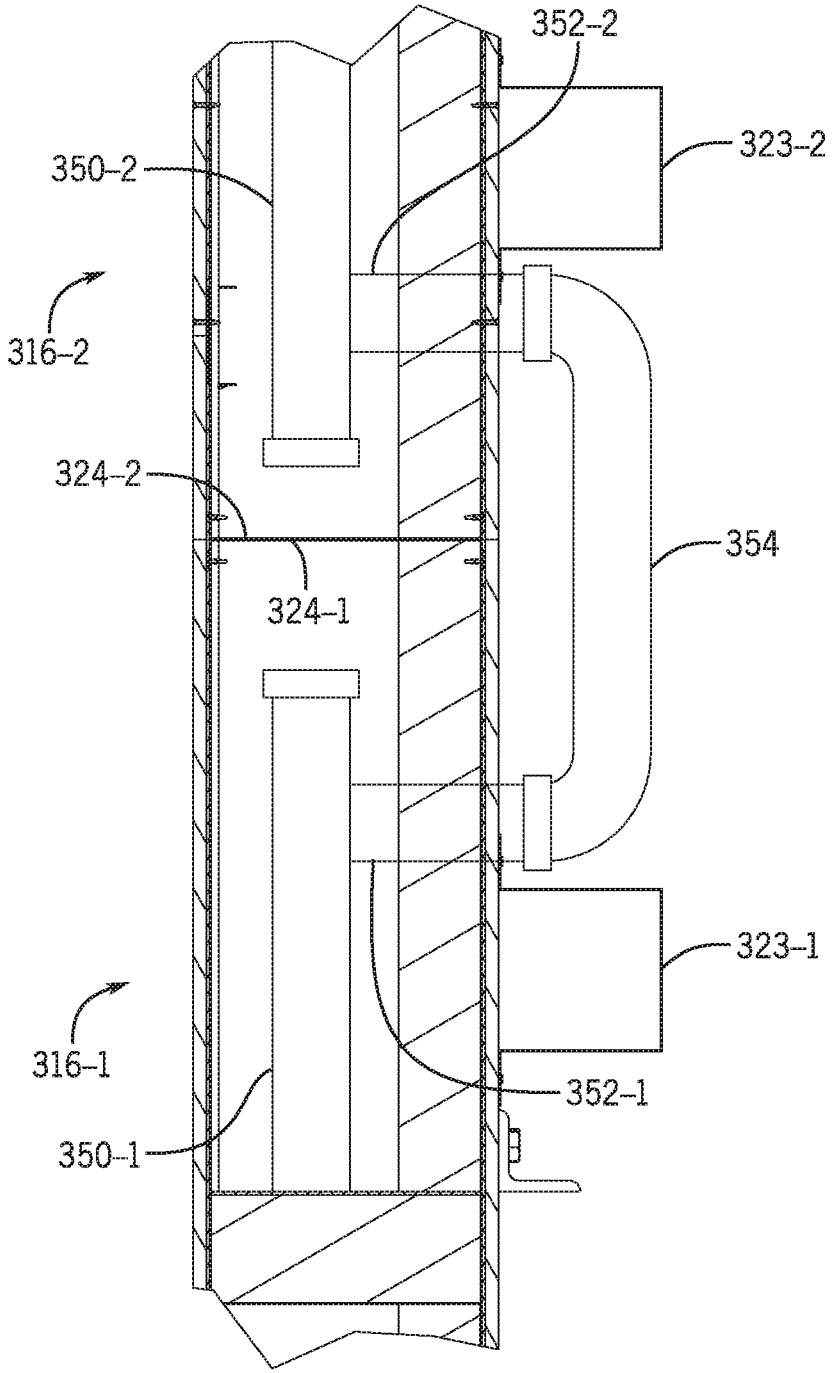
FIG. 6 is a partial elevation cross-sectional view of adjoining wall panels

FIG. 6 shows a partial elevation cross-sectional view of adjoining wall panels. FIG. 6 shows portions of wall panels 316-1 and 316-2, pipes 350-1 and 350-2, pipe diverters 352-1 and 352-2, and pipe fitting 354 between spacers 323-1 and 323-2. The various components shown in FIG. 6 are merely embodiments, and other variations, including eliminating components, combining components, and substituting components are all contemplated.

Wall panel 316-2 may be positioned vertically over wall panel 316-1, and the wall panels may be joined to one another and/or to other structure of the building. In some examples, the upper side of wall panel 316-1 may contact the lower side of panel 316-2. In some examples, the end members 324-1 and 324-2 may be provided against one another. In some examples tongue and groove interfaces may be provided between the adjoining sides to strengthen the joint between the panels. Wall panel 316-1 may include pipe 350-1 and wall panel 316-2 may include respective pipe 350-2. The pipes may be capped at each end. The pipes may include one or more pipe diverters, such as pipe diverter 352-1 of pipe 350-1 and pipe diverter 352-2 of pipe 350-2. A pipe fitting 354 may be connected to each of the fee ends of pipe diverters 352-1 and 352-2. The pipe fitting may be include a continuous pipe section that connects the two pipe diverters or a plurality of pipe sections joined together between the free ends of the pipe diverters. The pipe diverters and pipe fitting may be configured such that the pipe joint is fully enclosed within the space behind a finish panel (e.g., within a cavity defined between spacer 323-1 of the lower panel 316-1 and spacer 323-2 of the upper panel 316-2). Pipe connections may extend vertically, horizontally or obliquely. In some examples, cutouts may be provided through the spacers 323 to accommodate pipe connections between adjoining wall panels. Pipe connections may be formed on either side of the wall panels, e.g., as described previously with reference to FIGS. 5A and 5B.

FIG. 7 is an elevation cross-sectional view of a wall panel attached to other structure of a building. FIG. 7 shows beam 108, floor panel 114, wall panel 316, bracket 329, wall boards 330, 340, sides 331, 341, finish panels 345, and spacers 323-1, 323-2. The various components shown in FIG. 7 are merely embodiments, and other variations, including eliminating components, combining components, and substituting components are all contemplated.

Wall panel 316 which may include wall boards 330 and 340 defining opposite sides 331 and 341 may be attached to the structural frame of a building (e.g., to a beam 108) and/or to a floor panel 114. Side 331 may be an interior side defining an interior wall of a unit. Side 341 may be an exterior side defining an exterior wall of the building. The wall panel 316 may span multiple stories of the building. The wall panel 316 may thus be installed in the building after one or more floor panels have been installed. The floor panel 114 may be joined (e.g., mechanically fastened) to the beam 108. The wall panel 316 may be provide against the opposite side of the beam 108 at joined (e.g., mechanically fastened) thereto using bracket 329. In some examples, the panels may instead be welded to the frame. Gaps may be sealed and/or caulked and finishes may be installed for example by attaching a finish panels 345 associated with each unit to spacers 323-1, 323-2 located within the respective unit.

Figure 8:
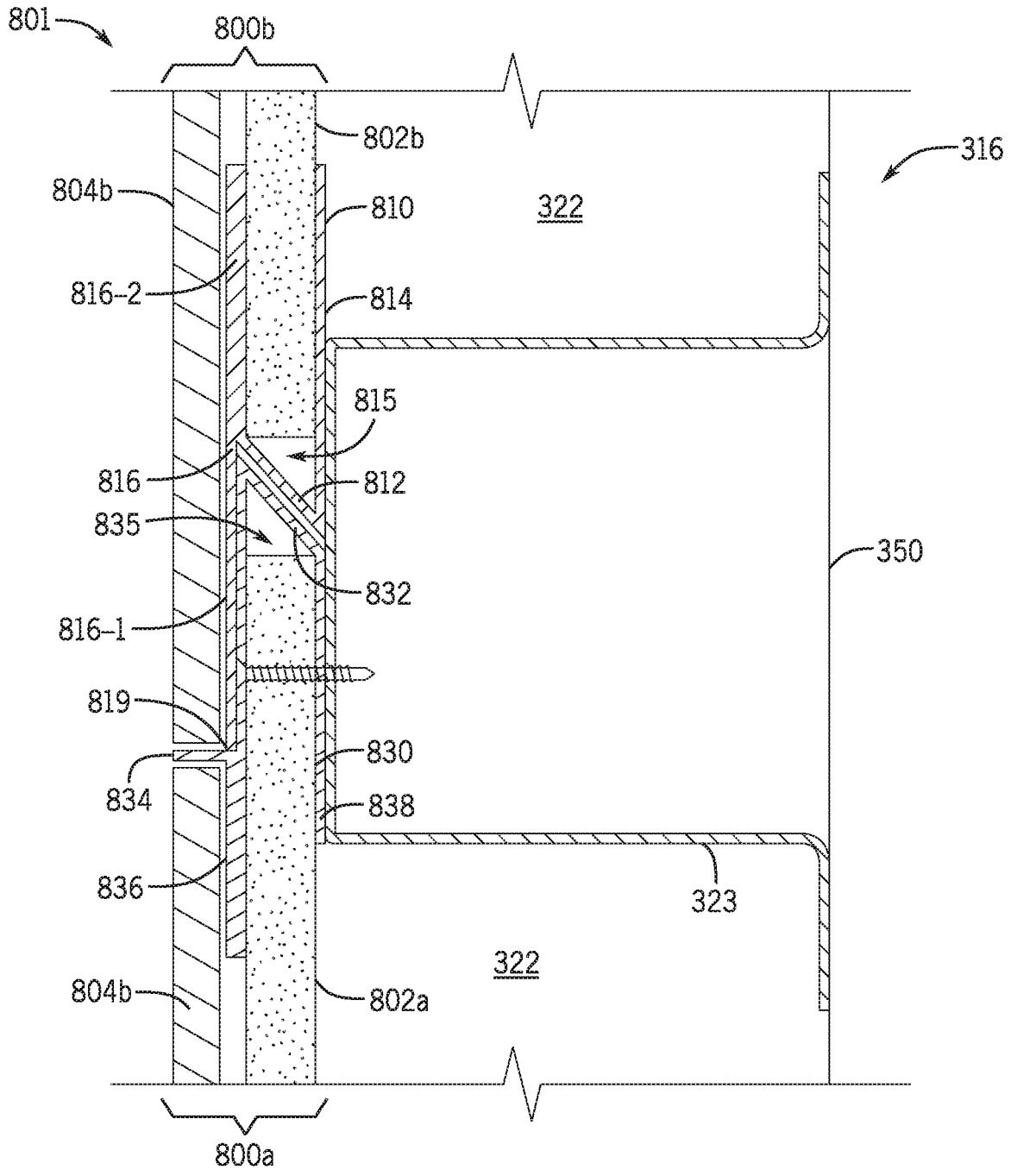
FIG. 8 is a partial elevation cross-sectional view of a finish panel system.

FIG. 8 is a partial elevation cross-sectional view of a finish panel system in accordance with further examples of the present disclosure. FIG. 8 shows wall board 350 and spacer 323 attached thereto, cavities 327 on opposite sides of the spacer 323, and upper and lower portions of adjoining finish panels 800*a* and 800*b*.

Each finish panel may include an inner layer and outer layer and a pair of cleats disposed along opposite edge portion of the finish panel. Each finish panel may be about 4 ft wide by about 10 ft long. Other dimensions may be used, for example a width of about 3 ft, 4 ft, 5 ft or more by a length of about 8 ft, 9 ft, 10 ft or more. It will be understood that the finish panels may be manufactured in any size as may be desired or suitable for a particular application. The inner layer (e.g., 802*a*, 802*b*) may be formed from a non-combustible material such as cement board, or MgO board. The outer layer (e.g., 804*a*, 804*b*) may be a decorative layer. In some examples, the outer layer (e.g., 804*a*, 804*b*) may be in the form of a ceramic, porcelain, or natural stone tile. The pair of cleats may include a lower cleat 810 and an upper cleat 830, which in the illustrated example are shown attached to the lower portion of finish panel 800*b* and the upper portion of finish panel 800*a*, respectively. While not shown in this view, it will be understood that the opposite (lower) end of finish panel 800*a* may be provided with a lower cleat 810 and the opposite (upper) end of finish panel 800*b* may be provided with an upper cleat 830. In this manner, multiple finish panels may be arranged side to side to cover a surface area of any choosing.

The lower cleat 810 may have a substantially Z-shaped cross-section defined by outer flange 816, inner flange 816 and sloped wall 812. The outer flange 816 may include a lower flange portion 816-1 extending from the sloped wall in one direction and an upper flange portion 816-2 extending from the sloped wall 812 in the opposite direction. The upper flange 816-1, the sloped wall 812 and the inner flange 814 may define channel 815 which receives the lower end of the inner layer (e.g., inner layer 802*b* of finish panel 800*b*). The upper cleat 830 may include inner and outer flanges 838 and 836, respectively, and sloped wall 832 which define an inverted channel 835 that receives the upper end of the inner layer (e.g., inner layer 802*a* of finish panel 800*a*). The walls 812 and 832 may slope in opposite directions with respect to the inner flanges 814 and 838 of cleats 810 and 830, respectively. That is, the sloped wall 812 may slope towards (e.g., forming an acute angled with) the inner flange 814, while the sloped wall 832 may slope away from (e.g., forming an obtuse angle with) the inner flange 838. The sloped walls 812 and 832 may have matching slopes such that when the cleats 810 and 830 are nested into one another the sloped walls 812 and 832 abut one another. The outer flange 836 of the upper cleat 830 may include a ledge 834. The ledge 834 may extend substantially perpendicularly to the flange 836. The ledge 834 may be wide enough to seat the outer flange 816 of cleat 810 and/or the outer layer 804*b* of the upper panel 800*b*. When the finish panels are installed, the edge 819 of flange 816 and the bottom side of the outer layer may abut against the ledge 834.

When installed, the finish panels 800*a*, 800*b* may be attached to a wall structure (such as to a pre-assembled wall panel 316) with the inner layers closer to the wall structure than the outer layers. A typical installation may involve installing a lower finish panel (e.g., finish panel 800*a*) first, followed by an upper finish panel (e.g., finish panel 800*b*) followed by yet another finish panel vertically over the upper finish panel and so on. The lower panel may be installed for example by mechanically fastening the finish panel to a spacer. A counter-sink bore hole and fastener may be used to allow the outer flange 816 of the lower cleat 810 to be placed substantially flush with the outer flange 836 of the upper cleat 830.

When installed, the sloped wall 832 of the cleat 830 may slope downward towards the wall structure and the cleat 810 may be slidably seated into the cleat 810 by moving the upper finish panel towards the installed lower finish panel in the vertical direction. Assisted by the weight of finish panel 800*b*, sloped wall 832 may operably engage sloped wall 812 to resist outward horizontal movement of finish panel 800*b*. The upper finish panel 800*b* may in this manner remain attached to the lower finish panel 800*a* without the aid of additional fasteners. In some examples, the upper portion of the upper finish panel may be mechanically fastened before the next panel is attached thereabove.

The finish panel attachment system 801 may be useful for finishing walls which may otherwise require sealing against moisture, such as surfaces of a bathroom. Typically, the installation of bathroom wall finishes is very time consuming, in part because each tile is laid one at a time with significant time expended in leveling each tile and ensuring equal spacing between the tiles to achieve uniform grout lines. Moreover, layers below the tile may need to be sealed against moisture intrusion and ground must be installed once all the tiles are arranged in the desired pattern. The finish panel attachment system 801 may obviate the need for grouting, sealing against moisture and/or individual leveling and aligning of tiles. Each finish panel 800*a*, 800*b* would arrive on the job site ready to be attached to a wall system, the installation of which may involve the simple stacking of one finish panel over another panel to form a continuous water impervious wall covering. The cleat system may not only simplify installation of the finish panels but may obviate the need for grouting between tiles as spaces between tiles may be filled by portions of the cleat system (e.g. ledge 834). In some examples a water impervious layer (e.g., waterproofing, which may be a membrane or applied as a liquid) may be applied over the flanges 816, 836 and/or between the inner and outer layers 802, 804 of each finish panel to further reduce the risk of water penetration behind the finish panel.

Figure 9:
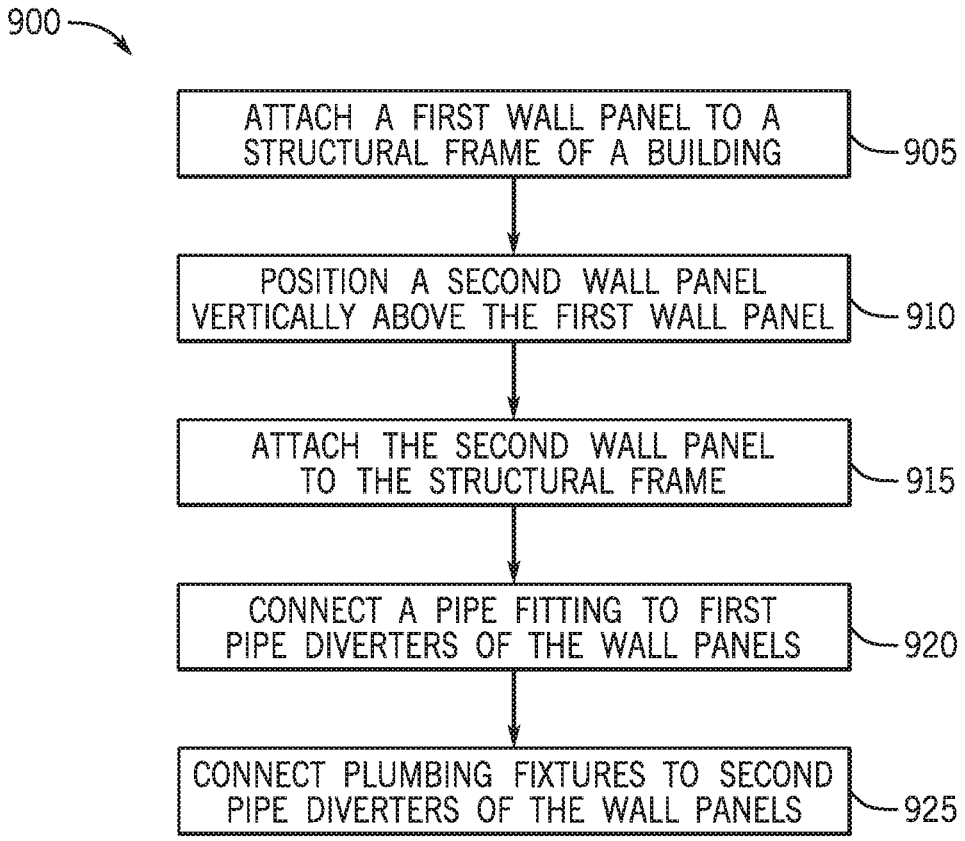
FIG. 9 is a flow diagram of an example method.

FIG. 9 is a flow diagram of an example method. The method 900 may be used to construct a wall system for a building, such as building 102. An example method may include one or more operations, functions or actions as illustrated by one or more of blocks 905-925. The various blocks shown in FIG. 9 are merely illustrative, and other variations, including eliminating, combining, and substituting blocks are all contemplated. In some embodiments, the blocks may be performed in a different order. In some other embodiments, various blocks may be eliminated. In still other embodiments, various blocks may be divided into additional blocks, supplemented with other blocks, or combined together into fewer blocks. Other variations of these specific blocks are contemplated, including changes in the order of the blocks, changes in the content of the blocks being split or combined into other blocks, etc. In some embodiments, the optional blocks may be omitted.

An example method 900 may include attaching a first pre-assembled wall panel to a structural frame of a building, as shown in block 905. A wall panel may be attached directly to the structural frame, such as with components that mount the panel to the frame, or indirectly attached to the structural frame, such as through attachment of the wall panel to other components (e.g., to a floor panel). The structural frame may include one or more beams and columns operatively connected to provide structural support for a building, such as building 102. The first pre-assembled wall panel may be disposed adjacent to at least one beam. In some examples, the pre-assembled wall panel may span, at least partially, multiple stories and may in such examples be adjacent to multiple vertically spaced beams. In some examples, the attaching of the first pre-assembled wall panel to a structural frame may include mechanically joining an angle bracket attached to the first pre-assembled wall panel to a horizontal structural member (e.g., beam 108) of a building such as building 102.

The method 900 may further include positioning a second pre-assembled wall panel vertically above the first pre-assembled wall panel, as shown in block 910. Each of the first and second pre-assembled wall panels may include at least one pipe which is at least partially inside the wall panel and which includes at least one pipe diverter exposed to an exterior of the wall panel. The second pre-assembled wall panel may be provided directly over the first pre-assembled wall panel, such that a bottom side of the second pre-assembled wall panel contacts a top side of the first pre-assembled wall panel. The adjacent sides of the wall panels may be in direct contact with one another. In some examples, intermediate layers may be provided between the adjacent sides of the wall panels. In some examples, interfacing components may be provided between the wall panels so as to substantially seal an interface between the two wall panels. The method 900 may include attaching the second pre-assembled wall panel to the structural frame of the building, as shown in block 915. For example, the second panel may be attached to directly to the structural frame, e.g., by joining the wall panel to a structural member such as a beam. In some examples, the second panel may be attached to the structural frame indirectly such as by attaching the wall panel to another panel, such as another wall panel and/or a floor panel.

The method 900 may further include connecting a pipe fitting to each of the flow diverters of the first and second wall panels to fluidly couple the pipes of the first and second pre-assembled wall panels. It will be understood that each of the wall panels may include multiple pipes, such as water supply pipes and drain pipes. Respective pipes may be fluidly connected using appropriately sized pipe fittings (e.g., pipe sections including elbows, angles, tees or others). Hot and cold water lines of vertically adjacent panels may be fluidly connected such that water can be supplied to units above those that are associated with a particular wall panel. Similarly, drain pipes may be connected such that wastewater can be drained down and to a main sewer line from any unit in the building. In some examples, the pipes in a wall panel may include multiple pipe diverters, some of which may be used for connecting the pipes of adjoining panels and other for connecting plumbing fixtures thereto, as shown in block 925. As previously noted, wall panels in accordance with the present disclosure may be sized to span multiple stories. That is, a wall panel may include an upper panel portion which extends above a floor level of an upper unit of the building and a lower panel portion which extends below a ceiling level of a lower unit of the building. In such examples, the method may further include attaching a floor panel to the structural frame at a location between the upper and lower panel portions. In some examples, the floor panel may be attached to the structural frame before either of the wall panels is attached to the structural frame. In some examples, the wall panel and the floor panel may be on opposite sides of the beam. The wall panel and the floor panel may be attached to opposite or to adjacent sides of the beam.

A pre-assembled wall panel in accordance with the present disclosure may include a panel frame which includes a plurality of studs and at least two end members. The end members may be horizontal members and the studs may be vertical members when the wall panel is installed in a building. The studs and end members may be orthogonal to one another. In some examples, the frame may be generally rectangular and the first and second end members may be provided at opposite ends of at least two studs. The first end member may be disposed at one end of the at least two studs and the second member may be disposed at an opposite end of the at least two studs. At least two studs may be connected to each of the first and second end members. Any number of studs may be disposed between the end members in other examples. In some examples, the frame may have a different shape and a different number of end members may be attached to opposite ends of two or more studs.

The wall panel may also include a first wall board connected to a first side of the panel frame. The first wall board may cover, fully or partially, the first side of the frame. The wall panel may also include a second wall board connected to a second side of the panel frame opposite the first side. The second wall board may cover, fully or partially, the second side of the frame. The wall panel may include a plurality of spacers. The spacers may be attached a wall board. In some examples, a plurality of spacers may be attached to the first wall board. In some examples, a plurality of spacers may be attached to the first wall board. In some examples, spacers may be attached to both the first and the second wall boards. The wall panel may further include a pipe which may be disposed between the first and second wall boards. The pipe may extend orthogonally to the end members. In some examples, the pipe or a portion thereof may extend obliquely within a wall panel between the end members. The pipe may include a pipe diverter, a free end of which may pass through an opening in one of the wall boards so as to expose an opening at the free end to an exterior of the wall panel.

In some examples, at least one wall of the wall panels may provide an interior wall of a unit. Wall finishes may be installed on the interior side, such as by fastening, bonding or otherwise connecting one or more finish panels to the wall panel. In some examples, the finish panels are attached to spacers to define cavities between the finish panels and the wall boards. The cavities may accommodate utilities. For example, one or more of the pipe fittings may be located behind the finish panels and may be partially of fully enclosed within the cavities, which may increase the aesthetic appearance of an interior of the building. Similarly, wall finishes may be installed to the opposite side of the panel, which may be another interior side or an exterior side. In some examples, connections between pipes of adjoining wall panels may be made on either side of the wall panel. In some embodiments, the wall panel may contain both plumbing and electrical utilities. In some embodiments, a wall panel may contain other utilities such as telecommunication equipment, ducts, heating, ventilation, and air conditioning (HVAC) equipment, fire sparkler piping, radiant heat piping, and/or drainage piping. Connections between utility lines of adjoining panels may be formed and at least partially concealed behind the finish panels in accordance with the present disclosure.

The panels may be configured to comply with one or more of the following building codes: fire, energy, handicap, life-safety, and acoustical (impact and ambient noise transfer). The panels may also be configured to comply with social and/or religious codes as desired. In some embodiments, the pre-assembled utility panels may be considered as a fully-integrated sub-assembly meeting fire, sound impact, energy, and life/safety codes. The utility panels may be fully integrated with electrical, fire protection, energy insulation, and sound isolation capabilities in some embodiments. The utility panels may be designed to achieve a fire rating set by the applicable building code, such as a two-hour fire rating. In some embodiments, the panels may provide a heating system for the building units. Materials, systems, methods, and/or apparatuses may be configured to comply with the International Building Code as it has been adopted in a jurisdiction.

The utility panels described herein may be fabricated off-site in a factory or shop and transported to the project jobsite for attachment to a structural frame, such as a structural exoskeleton, of a building. The off-site fabrication may include provision of utilities in the panels, such as wiring, plumbing, HVAC, and combinations thereof. The panels may be fabricated in various sizes, such as eight feet by twenty-two feet. Smaller infill panels may be prefabricated on a project-by-project basis to complete the building wall system. At the building site, the panel may be attached to floor panels, ceiling panels, end walls, demising walls, other utility walls, building utilities, or any combination thereof. The utility panel may provide support the overall exterior and/or interior wall system, which may include an exterior steel frame installed in the field in some embodiments.

The utility panel may provide an exterior wall and an interior wall. A frame, such as a light gauge frame, may support the utility panel. In some embodiments, the interior wall is drywall, and lightweight decorative panels are attached to the drywall. Opposite the interior wall, the frame may support an exterior wall, such as a structural insulated panel. An in-wall radiant heat member, sound and energy insulation, sound isolators for acoustically separating floors, fire sprinkler piping, electrical wiring and data cabling, or any combination thereof may be positioned between the interior and exterior wall of the utility panel. The utility panel composition may allow for utilities to be distributed both horizontally and vertically within the wall, which may allow for a single utility panel to service multiple units in a multi-story or multi-unit building.

The examples provided are for explanatory purposes only and should not be considered to limit the scope of the disclosure. Each example embodiment may be practical for a particular environment such as urban mixed-use developments, low-rise residential units, and/or remote communities. Materials and dimensions for individual elements may be configured to comply with one or more of the following building codes: fire, energy, handicap, life-safety, and acoustical (impact and ambient noise transfer) without departing from the scope of the principles of the disclosure. The elements and/or system may also be configured to comply with social and/or religious codes as desired. For example, materials, systems, methods, and/or apparatuses may be configured to comply with the International Building Code as it has been adopted in a jurisdiction.

The present disclosure is not to be limited in terms of the particular embodiments described in this application, which are intended as illustrations of various aspects. Many modifications and embodiments can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and embodiments are intended to fall within the scope of the appended claims. The present disclosure includes the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

The herein described subject matter sometimes illustrates different components contained within, or connected with, different other components. It is to be understood that such depicted architectures are merely embodiments, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific embodiments of operably couplable include but are not limited to physically mateable and/or physically interacting components and/or wirelessly interactable and/or wirelessly interacting components and/or logically interacting and/or logically interactable components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A pre-assembled wall panel, comprising:

a panel frame comprising a plurality of studs and first and second end members, wherein the first end member is disposed at one end of the plurality of studs and the second end member is disposed at an opposite end of the plurality of studs, and wherein each of the plurality of studs is connected to the first and second end members;

a first wall board connected to a first side of the panel frame;

a second wall board connected to a second side of the panel frame opposite the first side;

a plurality of spacers attached to at least one of the first wall board and the second wall board, wherein each spacer of the plurality of spacers is configured to support a finish panel in a spaced relation from the at least one of the first wall board and the second wall board; and a first pipe disposed between the first and second wall boards and that extends between the first and second end members, wherein the first pipe comprises a first pipe diverter, and wherein a first free end of the first pipe diverter passes through an opening in the first wall board or the second wall board, wherein the first free end of the first pipe diverter is configured to be attached to a pipe fitting that fluidly couples the first free end of the first pipe diverter to a second free end of a second pipe diverter of a second pipe disposed inside of another pre-assembled wall panel that is adjacent to the pre-assembled wall panel, wherein the first free end of the first pipe diverter and the pipe fitting are disposed in a space between the finish panel and the first wall board, and wherein fluidly coupling the first pipe diverter and the second pipe diverter with the pipe fitting disposed in the space between the finish panel and the first wall board avoids interconnection, of the first and second pipes, inside of the pre-assembled wall panel and the another pre-assembled wall panel.

2. The wall panel of claim 1, wherein the another pre-assembled wall panel is vertically adjacent to the pre-assembled wall panel.

3. The wall panel of claim 1, wherein the first pipe diverter comprises one of a T-shaped element or a Y-shaped element.

4. The wall panel of claim 1, wherein opposite ends of the first pipe, which are enclosed within the panel frame between the first and second wall boards, are capped.

5. The wall panel of claim 1, further comprising a pipe support member attached to the panel frame transversely to the plurality of studs.

6. The wall panel of claim 5, wherein the pipe support member comprises a C-shaped metal channel, and wherein the wall panel further comprises a conduit clamp operatively engaged with the C-shaped metal channel and the first pipe.

7. The wall panel of claim 6, wherein the pipe support member is connected to a track, which is connected to at least two adjacent studs, and wherein the C-shaped metal channel is received in the track.

8. The wall panel of claim 1, wherein the first pipe comprises one of a plurality of water pipes and drain pipes enclosed at least partially between the first and second wall boards.

9. The wall panel of claim 8, wherein each of the water pipes includes a pair of pipe diverters proximate opposite ends of each of the water pipes and at least one intermediate pipe diverter disposed between the pair of pipe diverters.

10. The wall panel of claim 1, wherein at least one of the first wall board and the second wall board comprises a plurality of pre-manufactured boards of non-combustible material.

11. The wall panel of claim 1, wherein:

the plurality of spacers comprises a plurality of hat channels each arranged in a respective horizontal line along a length of the pre-assembled wall panel, each hat channel extends continuously along the respective horizontal line, or each hat channel is formed as a plurality of spaced apart brackets that extend along the respective horizontal line, first and second spacers, which form two consecutive horizontal lines of spacers of the plurality of spacers, define a horizontal cavity between the first and second spacers, the horizontal cavity is sized to receive utilities that run horizontally within the horizontal cavity and that connect to other utilities of at least one other pre-assembled wall panel that is horizontally adjacent to the pre-assembled wall panel, so as to enable the utilities that run horizontally to be provided to a unit on a story of a building or to multiple units on the story of the building, and the finish panel covers the horizontal cavity so as to conceal the utilities received therein.

12. The wall panel of claim 1, wherein the plurality of spacers include a plurality of first spacers connected to the first wall board and a plurality of second spacers connected to the second wall board, and wherein a height of the first spacers is greater than a height of the second spacers.

13. The wall panel of claim 1, wherein the spacers are arranged vertically and define a plurality of vertically extending cavities.

14. The wall panel of claim 1, wherein the wall panel has a length of about 18 feet to about 22 feet.

15. The wall panel of claim 1, wherein the wall panel has an opening configured to accommodate a door for a unit.

16. A multi-story building, comprising:

a structural frame including at least one beam; and a first pre-assembled wall panel attached to the structural frame and comprising an upper panel portion which extends above a floor level of an upper unit of the building and a lower panel portion which extends below a ceiling level of a lower unit of the building, wherein the first pre-assembled wall panel comprises:

a panel frame comprising a plurality of studs and first and second end members, wherein the first end member is disposed at one end of the plurality of studs and the second end member is disposed at an opposite end of the plurality of studs, and wherein each of the plurality of studs is connected to the first and second end members;

a first wall board connected to a first side of the panel frame;

a second wall board connected to a second side of the panel frame opposite the first side;

a plurality of spacers attached to at least one of the first wall board and the second wall board, wherein each spacer of the plurality of spacers is configured to support a finish panel in a spaced relation from the at least one of the first wall board and the second wall board; and a first pipe disposed between the first and second wall boards and that extends between the first and second end members, wherein the first pipe comprises a first pipe diverter, and wherein a first free end of the first pipe diverter passes through an opening in the first wall board or the second wall board, wherein the first free end of the first pipe diverter is configured to be attached to a pipe fitting that fluidly couples the first free end of the first pipe diverter to a second free end of a second pipe diverter of a second pipe disposed inside of a second pre-assembled wall panel that is adjacent to the first pre-assembled wall panel, wherein the first free end of the first pipe diverter and the pipe fitting are disposed in a space between the finish panel and the first wall board, and wherein fluidly coupling the first pipe diverter and the second pipe diverter with the pipe fitting disposed in the space between the finish panel and the first wall board avoids interconnection, of the first and second pipes, inside of the first pre-assembled wall panel and the second pre-assembled wall panel.

17. The building of claim 16, wherein the first pre-assembled wall panel is configured to provide plumbing utilities to both the upper unit and the lower unit.

18. The building of claim 16, wherein:

the plurality of spacers comprises a plurality of hat channels each arranged in a respective horizontal line along a length of the pre-assembled wall panel, each hat channel extends continuously along the respective horizontal line, or each hat channel is formed as a plurality of spaced apart brackets that extend along the respective horizontal line, first and second spacers, which form two consecutive horizontal lines of spacers of the plurality of spacers, define a horizontal cavity between the first and second spacers, the horizontal cavity is sized to receive utilities that run horizontally within the horizontal cavity and that connect to other utilities of at least one other pre-assembled wall panel that is horizontally adjacent to the pre-assembled wall panel, so as to enable the utilities that run horizontally to be provided to a unit on a story of a building or to multiple units on the story of the building, and the finish panel covers the horizontal cavity so as to conceal the utilities received therein.

19. The building of claim 16, wherein the first pre-assembled wall panel further comprises insulation arranged perpendicular to the first and second wall boards between the upper and lower panel portions.

20. The building of claim 16, wherein the upper panel portion spans a full height of the upper unit and a partial height of another unit above the upper unit.

21. The building of claim 16, wherein the first pre-assembled wall panel is attached to the at least one beam, and wherein the building further comprises a floor panel attached to the at least one beam opposite the first pre-assembled wall panel.

22. A method to construct a utility wall of a building, the method comprising:

attaching a first pre-assembled wall panel to a structural frame of a building;

positioning a second pre-assembled wall panel vertically above the first pre-assembled wall panel, wherein the first pre-assembled wall panel comprises:

a panel frame comprising a plurality of studs and first and second end members, wherein the first end member is disposed at one end of the plurality of studs and the second end member is disposed at an opposite end of the plurality of studs, and wherein each of the plurality of studs is connected to the first and second end members;

a first wall board connected to a first side of the panel frame;

a second wall board connected to a second side of the panel frame opposite the first side;

a plurality of spacers attached to at least one of the first wall board and the second wall board, wherein each spacer of the plurality of spacers is configured to support a finish panel in a spaced relation from the at least one of the first wall board and the second wall board; and a first pipe disposed between the first and second wall boards and that extends between the first and second end members, wherein the first pipe comprises a first pipe diverter, and wherein a first free end of the first pipe diverter passes through an opening in the first wall board or the second wall board;

attaching the second pre-assembled wall panel to the structural frame of the building; and attaching the first free end of the first pipe diverter to a pipe fitting that fluidly couples the first free end of the first pipe diverter to a second free end of a second pipe diverter of a second pipe disposed inside of the second pre-assembled wall panel that is vertically above the first pre-assembled wall panel, wherein the first free end of the first pipe diverter and the pipe fitting are disposed in a space between the finish panel and the first wall board, and wherein fluidly coupling the first pipe diverter and the second pipe diverter with the pipe fitting disposed in the space between the finish panel and the first wall board avoids interconnection, of the first and second pipes, inside of the first and second pre-assembled wall panels.

23. The method of claim 22, wherein the attaching the first pre-assembled wall panel to the structural frame includes mechanically joining an angle bracket attached to the first pre-assembled wall panel to a horizontal structural member of the building.

24. The method of claim 22, wherein the first pre-assembled wall panel includes an upper panel portion which extends above a floor level of an upper unit of the building and a lower panel portion which extends below a ceiling level of a lower unit of the building, and wherein the method further comprises attaching a floor panel to the structural frame at a location between the upper and lower panel portions before attaching at least one of the first and second pre-assembled wall panels to the structural frame.

25. The method of claim 22, wherein:

the first and second pipes of each respective first and second pre-assembled wall panels further comprise additional pipe diverters, and wherein the method further comprises connecting plumbing fixtures to the additional pipe diverters, the plurality of spacers comprises a plurality of hat channels each arranged in a respective horizontal line along a length of the pre-assembled wall panel, each hat channel extends continuously along the respective horizontal line, or each hat channel is formed as a plurality of spaced apart brackets that extend along the respective horizontal line, first and second spacers, which form two consecutive horizontal lines of spacers of the plurality of spacers, define a horizontal cavity between the first and second spacers, the horizontal cavity is sized to receive utilities that run horizontally within the horizontal cavity and that connect to other utilities of at least one other pre-assembled wall panel that is horizontally adjacent to the pre-assembled wall panel, so as to enable the utilities that run horizontally to be provided to a unit on a story of a building or to multiple units on the story of the building, and the finish panel covers the horizontal cavity so as to conceal the utilities received therein.

* * * * *